US008586852B2

(12) United States Patent
Tsuji

(10) Patent No.: US 8,586,852 B2
(45) Date of Patent: Nov. 19, 2013

(54) STORAGE MEDIUM RECORDED WITH PROGRAM FOR MUSICAL PERFORMANCE, APPARATUS, SYSTEM AND METHOD

(75) Inventor: Yuki Tsuji, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 76 days.

(21) Appl. No.: 13/222,428

(22) Filed: Aug. 31, 2011

(65) Prior Publication Data

US 2012/0266739 A1 Oct. 25, 2012

(30) Foreign Application Priority Data

Apr. 22, 2011 (JP) ..... 2011-096551

(51) Int. Cl.
*G10H 1/46* (2006.01)
*G10H 3/12* (2006.01)

(52) U.S. Cl.
USPC ..... 84/741; 84/615; 84/633; 84/723

(58) Field of Classification Search
None
See application file for complete search history.

(56) References Cited

U.S. PATENT DOCUMENTS

| | | | | |
|---|---|---|---|---|
| 5,585,584 | A * | 12/1996 | Usa | 84/600 |
| 6,897,779 | B2 * | 5/2005 | Nishitani et al. | 340/573.1 |
| 7,842,875 | B2 * | 11/2010 | Villa et al. | 84/609 |
| 2002/0166437 | A1 * | 11/2002 | Nishitani et al. | 84/600 |
| 2002/0166439 | A1 * | 11/2002 | Nishitani et al. | 84/600 |
| 2002/0170413 | A1 * | 11/2002 | Nishitani et al. | 84/600 |
| 2003/0066413 | A1 * | 4/2003 | Nishitani et al. | 84/615 |
| 2006/0185502 | A1 * | 8/2006 | Nishitani et al. | 84/615 |
| 2006/0191401 | A1 * | 8/2006 | Ueshima et al. | 84/724 |
| 2007/0221046 | A1 * | 9/2007 | Ozaki et al. | 84/612 |
| 2012/0103168 | A1 * | 5/2012 | Yamanouchi | 84/723 |
| 2012/0266739 | A1 * | 10/2012 | Tsuji | 84/633 |

FOREIGN PATENT DOCUMENTS

JP 63-191195 8/1988

* cited by examiner

*Primary Examiner* — Marlon Fletcher
(74) *Attorney, Agent, or Firm* — Nixon & Vanderhye, P.C.

(57) ABSTRACT

Provided is a program for musical performance which causes a computer of a musical performance apparatus to function as a posture variation acquisition unit 101 for acquiring the posture variation of a controller 5 per frame based on the angular velocity with respect to the posture or movement of the controller 5, a volume parameter setting unit 102 for setting a volume parameter for deciding the volume according to the posture variation, and a sound signal output unit 106 for outputting a sound signal of the volume according to the volume parameter.

20 Claims, 19 Drawing Sheets

STORAGE MEDIUM RECORDED WITH PROGRAM FOR MUSICAL PERFORMANCE, APPARATUS, SYSTEM AND METHOD

This application is based upon and claims the benefit of priority of the prior Japanese Patent Application No. JP2011-096551, filed on Apr. 22, 2011, the entire contents of which are incorporated herein by reference.

FIELD

The present invention relates to a storage medium recorded with a program for musical performance that produces sound based on movement of a user, a musical performance apparatus, a musical performance system and a musical performance method.

BACKGROUND

Conventionally, a musical sound control apparatus for controlling the musical sound by detecting the operation status of a person's hand, feet or the like has been proposed (refer to Japanese Patent Application Laid-open No. S63-191195). Japanese Patent Application Laid-open No. S63-191195 describes that either the pitch or volume can be changed according to the strength of the waving of the stick provided to the acceleration sensor; that is, the signal level of the acceleration signal that is output from the acceleration sensor.

Conventionally, there is technology for controlling the production of sound based on the acceleration that is detected by the acceleration sensor in the simulation of instruments. Nevertheless, for example, with an instrument that produces sound as a result of a sounding body being frictioned (stroked), sound is produced even if the movement of frictioning (stroking) the sounding body is a movement in which positive acceleration is not detected. Movement in which positive acceleration is not detected is, for example, uniform motion, retarded motion or the like.

In other words, with an instrument that produces sound as a result of a sounding body being frictioned (stroked), the acceleration of motion of frictioning (stroking) the sounding body and the volume do not necessarily have correspondence. Thus, was difficult to perform natural volume control according to the user's movement upon simulating an instrument that produces sound as a result of a sounding body being frictioned (stroked) with the conventional volume control based on acceleration.

In light of the foregoing problems, an object of this invention is to enable natural volume control in a storage medium recorded with a program for musical performance that produces sound based on movement of a user, a musical performance apparatus, a musical performance system and a musical performance method.

SUMMARY

The present invention adopted the following means to resolve the foregoing problems. Specifically, the present invention is a storage medium recorded with a program for musical performance which causes a computer of a musical performance apparatus for outputting sound based on movement of a predetermined target, to function as posture variation acquisition means for acquiring posture variation of the predetermined target in a predetermined interval based on measurement information concerning the posture or movement of the predetermined target, volume parameter setting means for setting a volume parameter for deciding a volume according to the posture variation, and sound signal output means for outputting a sound signal of the volume according to the volume parameter.

Note that the present invention can be used for the simulation of a sounding device that produces sound as a result of a sounding body being frictioned (stroked). As an example of a sounding device that produces sound as a result of a sounding body being frictioned (stroked), there is a bow-drawn, sringed instrument that produces sound by frictioning (stroking) strings with a bow. In this kind of sounding device, the sounding body vibrates and produces sound by being frictioned (stroked). In the present invention, the predetermined target in which its movement is measured is, for example, a controller or a user's hand that is portrayed as a bow of a bow-drawn stringed instrument. The present invention acquires the posture variation of the predetermined target in a predetermined interval (for example, unit time) based on measurement information concerning the measurement of this kind of predetermined target, and sets the volume parameter according to the posture variation.

Note that, as the means for obtaining the measurement information, for example, a sensor or the like built into the controller may be used, but the means for measuring the movement of the predetermined target of the present invention is not limited to a sensor built into the controller. For instance, it is also possible to take an image of the user's hand movement using a sensor of a camera or the like, and thereby obtain the measurement information concerning the user's hand movement.

Moreover, as the posture variation in a predetermined interval, for example, the angular velocity of the predetermined target or a vector showing the component of rotational motion of the predetermined target can be used. According to the present invention, by setting the volume parameter based on this kind of posture variation, natural volume control can be performed in the simulation of a sounding device that produces sound as a result of the sounding body being frictioned (stroked). Note that, when using the angular velocity as the posture variation, the angular velocity obtained as the measurement information may be used as is.

Moreover, the posture variation acquisition means may acquire the posture variation as a result of the posture variation of the predetermined target being calculated in a predetermined interval relative to a coordinate system defined in a real space based on the measurement information.

For example, the posture variation can be acquired by calculating the displacement of at least one of the axes among the three axes defining the posture of the predetermined target relative to the respective components of the coordinate system defined in the real space.

Moreover, the posture variation acquisition means may acquire a plurality of posture variations of the predetermined target relative to axes of the coordinate system defined in the real space, and the volume parameter setting means may set the volume parameter based on two or more posture variations in descending order of value among the plurality of posture variations acquired by the posture variation acquisition means.

As a result of using two or more higher posture variations which more greatly reflect the change of posture of the predetermined target, even if the posture of one part becomes saturated, the appropriate posture variation for acquiring the volume parameter can be obtained. For example, the posture variation acquisition means may acquire four posture variations of two axes for defining the posture of the predetermined target relative to two axes in the coordinate system defined in the real space, for each combination of axes, and the volume parameter setting means may set the volume parameter based on two posture variations in descending order of value among the four posture variations acquired by the posture variation acquisition means.

Moreover, the posture variation acquisition means may acquire, as the posture variation, an average value of the posture variations acquired a plurality of times within a predetermined period.

By acquiring an average value of the posture variations acquired a plurality of times within a predetermined period, it is possible to obtain the posture variation that is less influenced by the user's unintended movement.

Moreover, the volume parameter setting means may set the volume parameter based on information prescribing a correspondence of the posture variation and the volume parameter, and, in the information prescribing the correspondence of the posture variation and the volume parameter, tendency of inclination of change of the volume parameter relative to change of the posture variation may differ for each range of the posture variation.

As a result of the above, it is possible to provide a natural volume change according to the sounding device of the simulation target.

Moreover, the program for musical performance may causes the computer to further function as output volume control means for stopping the output of the sound signal by the sound signal output means for a predetermined time or lowering the output volume of the sound signal by the sound signal output means when it is determined, based on the measurement information, that the positive and negative of angular acceleration in a predetermined direction have inverted.

As a result of the above, it is possible to change the volume pursuant to the user's reversion operation or the like and enable the user to feel like he/she actually operating the sounding device.

Moreover, the musical performance apparatus simulates a stringed instrument having a plurality of strings stretched in substantially the same direction, and the program may cause the computer to further function as string designation information retention means for retaining string designation information which designates a string that is currently a target to be sounded among the plurality of strings, and string changing means for changing the string designated by the string designation information when it is determined, based on the measurement information, that angular acceleration to a circumferential direction centering on a direction in which the plurality of strings are stretched has exceeded a predetermined threshold.

As a result of the above, the user can perform string changing with an operation that is similar to the movement of actual string changing in the stringed instrument of the simulation target, and change the pitch of the sound to be produced.

Moreover, the predetermined target is a controller with a built-in gyro sensor to be operated by a user, and the measurement information may be angular velocity or angular acceleration measured by the gyro sensor.

Note that there is no limitation in the mode of operation when the controller is to be operated by the user. For example, the user can operate the controller by gripping or wearing the controller, or in other modes.

The present invention can also be comprehended as a musical performance apparatus, a musical performance system including such a musical performance apparatus, or a musical performance method that is executed by a computer. Moreover, the present invention may also be a result of recording the foregoing program in a recording medium that is readable by a computer or other devices and machines. Here, a recording medium that is readable by a computer and the like refers to a recording medium which electrically, magnetically, optically, mechanically or chemically stores information such as data and programs, and which can be read by a computer and the like.

According to the present invention, natural volume control can be performed in a storage medium recorded with a program for musical performance that produces sound based on the movement of the user, a musical performance apparatus, a musical performance system and a musical performance method.

DESCRIPTION OF EMBODIMENTS

Embodiments in the case of working the present invention as a game device which simulates a sounding device are now explained with reference to the drawings. Note that the embodiments explained below merely illustrate an example in the case of working the present invention, and do not limit the present invention to the specific configuration explained below. Upon working the present invention, specific configurations may be adopted as needed according to embodiments.

<Configuration of System>

[Overall Configuration of Game System]

Figure 1:
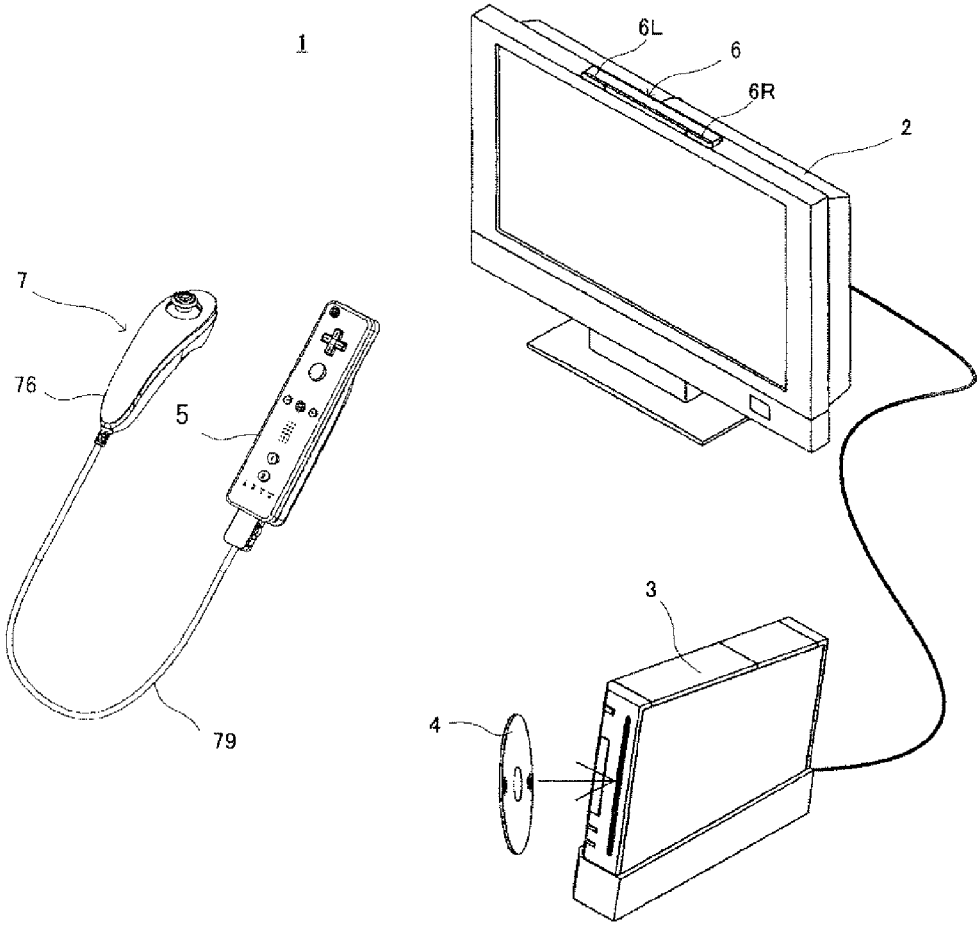
FIG. 1 is an external view of the game system according to the embodiments.

A game system 1 including the game device according to an embodiment of the present invention is now explained with reference to FIG. 1. FIG. 1 is an external view of the game system 1. Taking a floor-standing type game device as an example, the game device and game program of this embodiment are now explained. In FIG. 1, the game system 1 includes a television receive (hereinafter simply referred to as the "TV") 2, a game device 3, an optical disk 4, an input device 7, and marker unit 6. This system is for executing game processing with the game device 3 based on game operations using the input device 7.

The optical disk 4, which is an example of an information storage medium that is used replaceably in the game device 3, is removably inserted into the game device 3. The optical disk 4 stores a game program to be executed in the game device 3. An insertion slot of the optical disk, 4 is provided on the front face of the game device 3. The game device 3 executes the game processing by reading and executing the game program stored in the optical disk 4 inserted into the insertion slot.

The TV 2 as an example of a display device is connected to the game device 3 via a connection cord. The TV 2 displays the game image that is obtained as a result of the game processing that is executed in the game device 3. Moreover, a marker unit 6 is disposed around the screen of the TV 2 (at the upper part of the screen in FIG. 1). The marker unit 6 comprises two markers 6R and 6L on either end thereof. The marker 6R (same applies to the marker 6L) is specifically one or more infrared LEDs, and outputs infrared light forward from the front of the TV 2. The marker unit 6 is connected to the game device 3, and the game device 3 can control the lighting of the respective infrared LEDs of the marker unit 6.

The input device 7 provides, to the game device 3, operational data showing the contents of the operation that was performed to itself. In this embodiment, the input device 7 includes a controller 5 and a sub unit 76. As described in detail later, the input device 7 is configured such that the sub unit 76 is removably connected to the controller 5. The controller 5 and the game device 3 are connected via wireless communication. In this embodiment, for example, the Bluetooth (registered trademark) technology is used for the wireless communication between the controller 5 and the game device 3. Note that the controller 5 and the game device 3 may be wire-connected in the other embodiments.

[Internal Configuration of Game Device 3]

Figure 2:
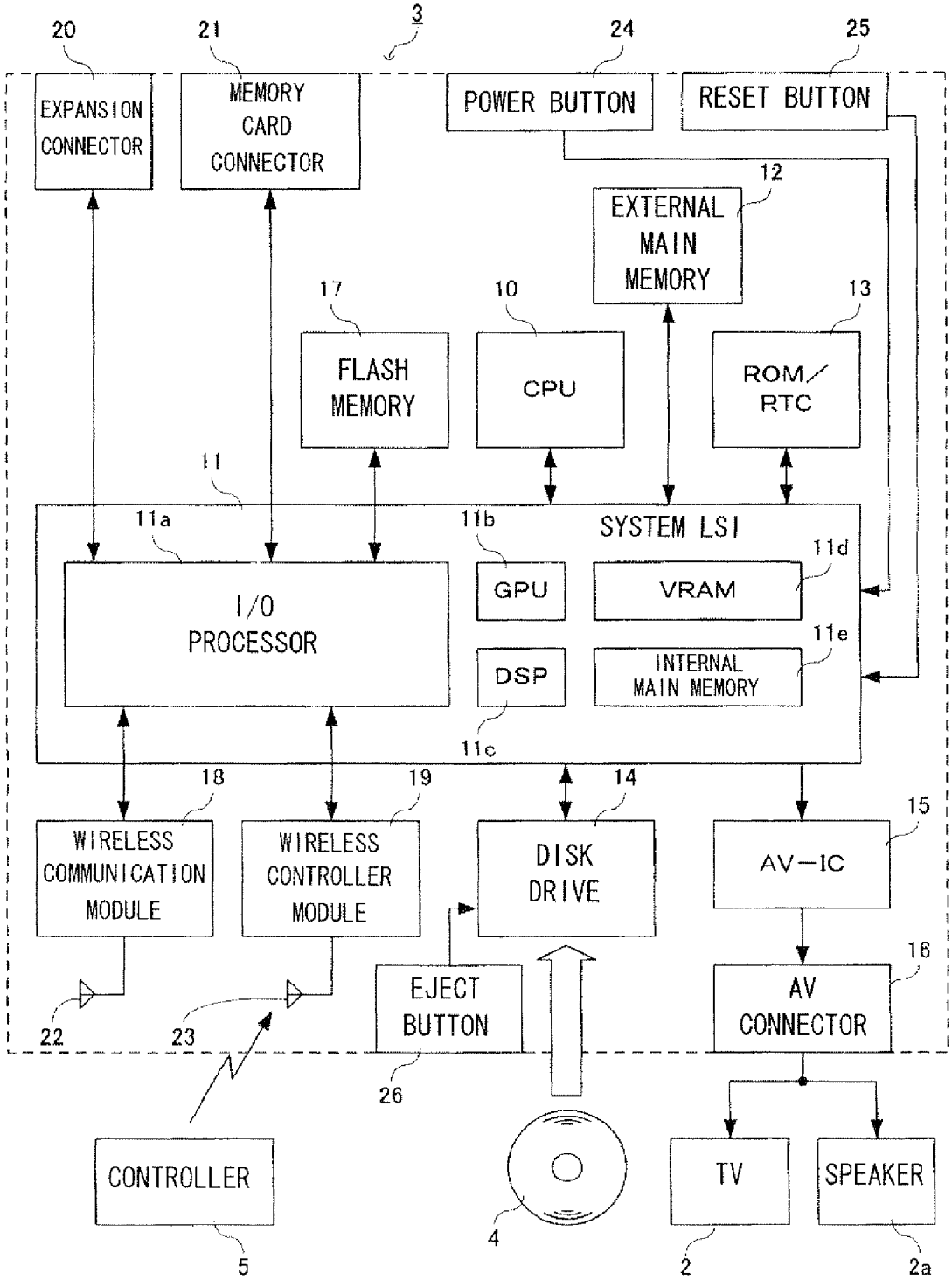
FIG. 2 is a functional block diagram of the game device according to the embodiments.

The internal configuration of the game device 3 is now explained with reference to FIG. 2. FIG. 2 is a block diagram showing the configuration of the game device 3. The game device 3 includes a CPU 10, a system LSI 11, an external main memory 12, a ROM/RTC 13, a disk drive 14, an AV-IC. 15, and so on.

The CPU 10 is used for performing the game processing by executing the game program stored on the optical disk 4, and functions as a game processor. The CPU 10 is connected to the system LSI 11. In addition to the CPU 10, connected to the system LSI 11 are the external main memory 12, the ROM/RTC 13, the disk drive 14 and the AV-IC 15. The system LSI 11 performs processing such as the control of data transfer between the respective constituent elements connected thereto, generation of image to be displayed, and acquisition of data from the external apparatus. The internal configuration of the system LSI 11 will be described later. The volatile external main memory 12 is used for storing programs such as the game program read from the optical disk 4 and the game program read from the flash memory 17, or storing various data, and is also used as the work area or buffer area of the CPU 10. The ROM/RTC 13 includes a ROM (so-called boot ROM) loaded with a program for booting the game device 3, and a clock circuit (RTC: Real Time Clock) for clocking the time. The disk drive 14 reads program data, texture data and the like from the optical disk 4, and writes the read data into the internal main memory 11*e* described later or the external main memory 12.

Moreover, the system LSI 11 is additionally provided with an input/output processor (I/O processor) 11*a*, a CPU (Graphics Processor Unit) 11*b*, a DSP (Digital Signal Processor) 11*c*, a VRAM 11*d*, and an internal main memory 11*e*. Although not shown, these constituent elements 11*a* to 11*e* are mutually connected via an internal bus.

The GPU 11*b* forms a part of the drawing means, and generates images according to the graphics command (drawing command) from the CPU 10. The VRAM 11*d* stores data (data such as polygon data and texture data) required for the GPU 11*b* to execute the graphics command. When images are generated, the CPU 11*b* creates image data based on the data stored in the VRAM 11*d*.

The DSP 11*c* functions as an audio processor, and generates sound signals by using the sound data and sound waveform (tone) data stored in the internal main memory 11*e* and the external main memory 12.

The image data and sound signal generated as described above are read by the AV-IC 15. The AV-IC 15 outputs the read image data to the TV 2 via an AV connector 16, and outputs the read sound signal to a speaker 2*a* built into the TV 2. Consequently, images are displayed on the TV 2 and sound is output from the speaker 2*a*.

The input/output processor 11*a* executes the transfer of data between the constituent elements connected thereto, and executes the download of data from an external apparatus. The input/output processor 11*a* is connected to a flash memory 17, a wireless communication module 18, a wireless controller module 19, an expansion connector 20, and a memory card connector 21. An antenna 22 is connected to the wireless communication module 18, and an antenna 23 is connected to the wireless controller module 19.

The input/output processor 11*a* is connected to a network via the wireless communication module 18 and the antenna 22, and can communication with other game devices and various servers that are connected to the network. The input/output processor 11*a* periodically accesses the flash memory 17 to detect whether any data needs to be a sent to the network, and, if there is such data, sends that to the network via the wireless communication module 18 and the antenna 22. Moreover, the input/output processor 11*a* receives the data sent from other game devices and the data downloaded from a download server via the network, the antenna 22 and the wireless communication module 18, and stores the received data in the flash memory 17. The CPU 10 reads the data stored in the flash memory 17 and uses the game program by executing the game program. The flash memory 17 may store, in addition to the data that is transferred between the game device 3 and other game devices or various servers, save data of the game (result data or midway data of the game) that was played using the game device 3.

Moreover, the input/output processor 11*a* receives, via the antenna 23 and the wireless controller module 19, the operational data sent from the controller 5, and stores (temporarily stores) it in the buffer area of the internal main memory 11*e* or the external main memory 12.

In addition, the expansion connector 20 and the memory card connector 21 are connected to the input/output processor 11*e*. The expansion connector 20 is a connector for interfaces such as USB and SCSI, and can communicate with the network in substitute for the wireless communication module 18 by connecting a media such as an external storage medium, connecting a peripheral device such as another controller, or connecting a wired communication connector. The memory card connector 21 is a connector for connecting an external storage medium such as a memory card. For example, the input/output processor 11*a* accesses the external storage medium via the expansion connector 20 or the memory card connector 21, and can thereby store the data in the external storage medium or read the data from the external storage medium.

The game device 3 is provided with a power button 24, a reset button 25, and an eject button 26. The power button 24 and the reset button 25 are connected to the system LSI 11. When the power button 24 is turned ON, power is supplied to the respective constituent elements of the game device 3 via an AC adapter not shown. When the reset button 25 is pressed, the system LSI 11 reboots the boot program of the game device 3. The eject button 26 is connected to the disk drive 14. When the eject button 26 is pressed, the optical disk 4 is ejected from the disk drive 14.

[Configuration of Input Device 7]

Figure 3:
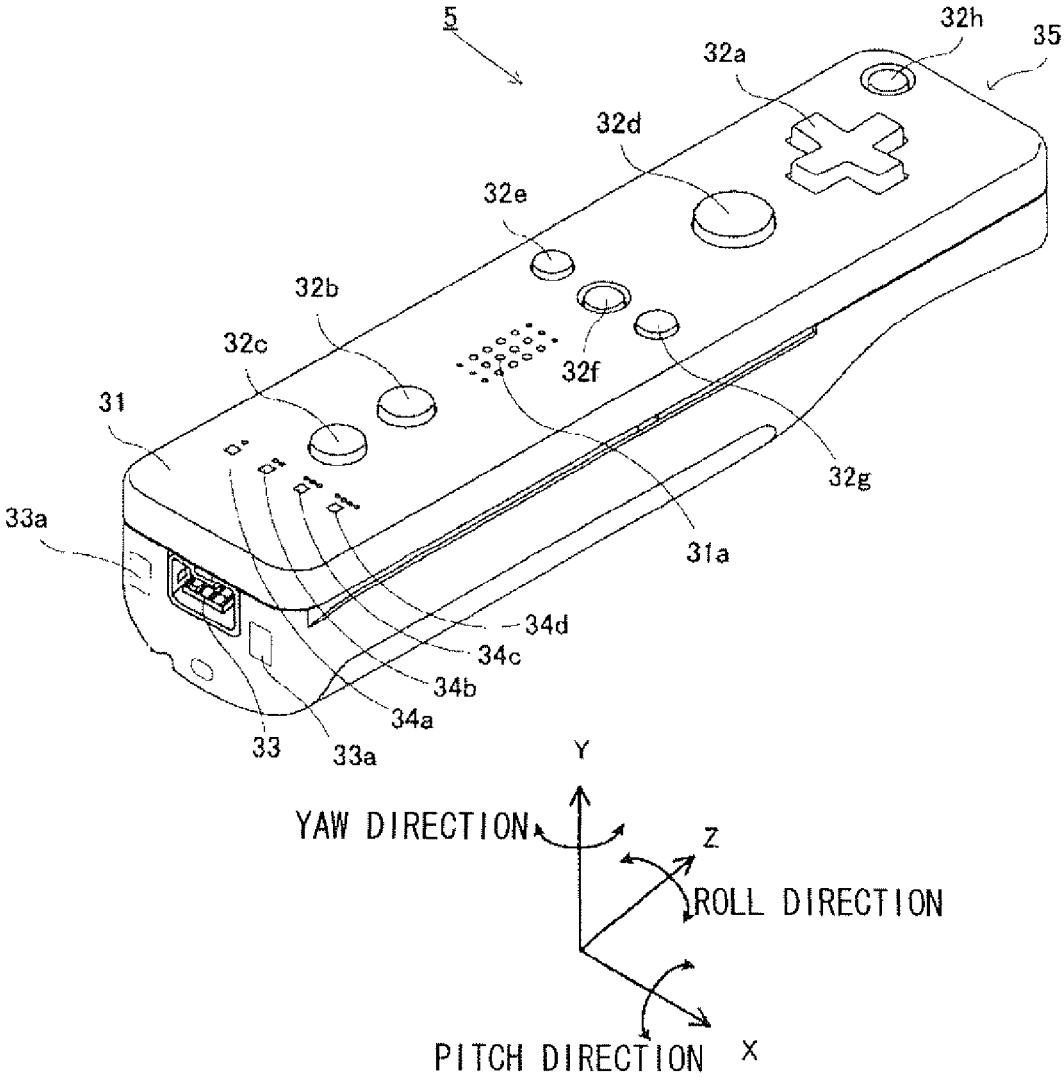
FIG. 3 is a perspective view showing the external configuration of the controller according to the embodiments.
Figure 4:
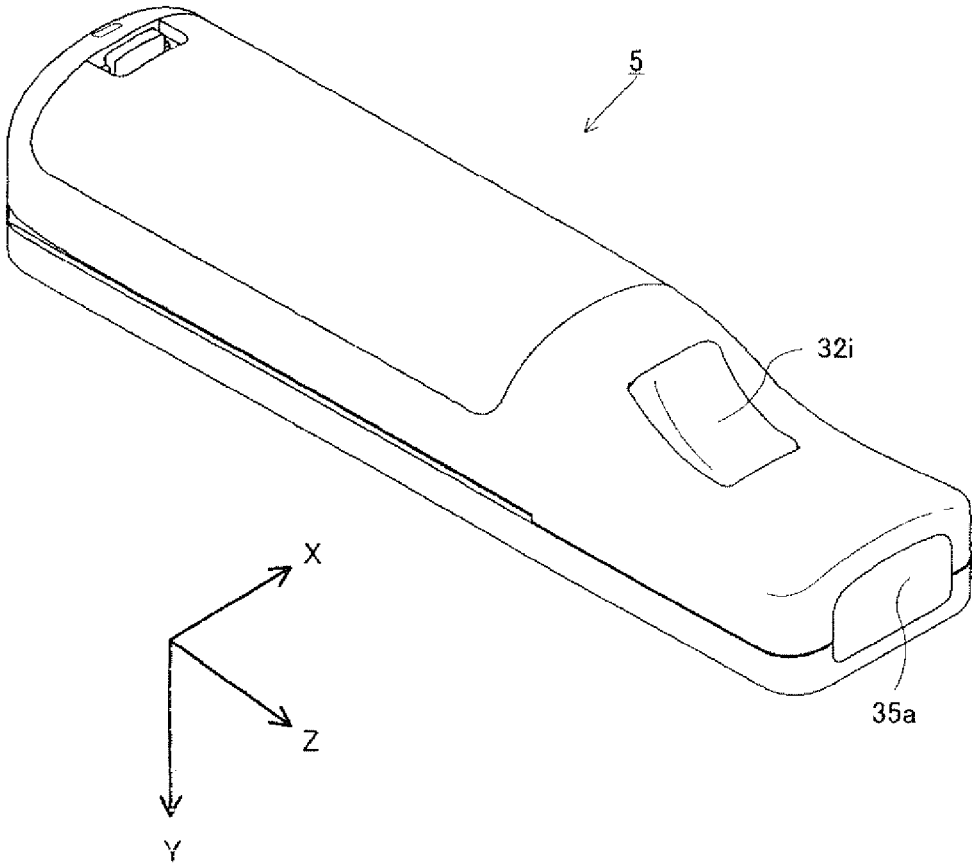
FIG. 4 is a perspective view showing the external configuration of the controller according to the embodiments.

The input device 7 is now explained with reference to FIG. 3 to FIG. 5. FIG. 3 is a perspective view showing the external configuration of the input device 7. FIG. 4 is a perspective view showing the external configuration of the controller 5. FIG. 3 is a perspective view of the controller 5 as seen from the upper rear side, and FIG. 4 is a perspective view of the controller 5 as seen from the lower front side.

The controller 5 includes a housing 31 that is formed, for example, via plastic molding. The housing 31 is formed in a substantial rectangular shape with its front-back direction (Z-axis direction shown in FIG. 3) as its longitudinal direction, and, as a whole, is of a size that can be gripped by an adult or a child using one hand. The user can perform game operations by pressing the buttons provided to the controller 5 and moving the controller 5 itself to change the position or posture thereof.

The housing 31 is provided with a plurality of operation buttons. As shown in FIG. 3, the top face of the housing 31 is provided with a cross button 32*a*, a first button 32*b*, a second button 32*c*, an A button 32*d*, a minus button 32*e*, a home button 32*f*, a plus button 32*g*, and a power button 32*h*. Meanwhile, as shown in FIG. 4, a concave part is formed on the bottom face of the housing. 31, and a B button 32*i* is provided to the backside inclined surface of such concave part. Each of the operation buttons 32*a* to 32*i* is assigned a function as needed according to the game program that is executed by the game device 3. Moreover, the power button 32*h* is used for remotely turning ON/OFF the power of the game device 3. The top face of the home button 32*f* and the power button 32*h* is caved in the top face of the housing 31. It is thereby possible to prevent the user from erroneously pressing the home button 32*f* or the power button 32*h*.

A connector 33 is provided to the rear face of the housing 31. The connector 33 is used for connecting other devices (for example, the sub unit 76 or another controller) to the controller 5. Moreover, a locking hole 33*a* for preventing the foregoing device from easily becoming separated is provided to either end of the connector 33 on the rear face of the housing 31.

A plurality of (four in FIG. 3) LEDs 34*a* to 34*d* are provided rearward on the top face of the housing 31. Here, the controller 5 is given a controller type (number) for differentiation from the other main controllers. Each of the LEDs 34*a* to 34*d* is used for notifying the user of the foregoing controller type that is currently set to the controller 5, and notifying the battery power of the controller 5. Specifically, when game operations are performed using the controller 5, one among the plurality of LED 34*a* to 34*d* is illuminated according to the foregoing controller type.

Moreover, the controller 5 includes an imaging information arithmetic unit 35 (FIG. 6), and, as shown in FIG. 4, the front face of the housing 31 is provided with a light incident face 35*a* of the imaging information arithmetic unit 35. The light incident face 35*a* is configured from a material that at least allows the transmission of the infrared light from the markers 6R and 6L.

A sound through hole 31*a* for emitting sound from a speaker (not shown) built into the controller 5 to the outside is formed between the first button 32*b* and the home button 32*f* on the top face of the housing 31.

Moreover, the controller 5 has an acceleration sensor 37 (refer to FIG. 6) for detecting the acceleration (including gravitational acceleration) of the controller 5, and gyro sensors (biaxial gyro sensor 55 and uniaxial gyro sensor 56 shown in FIG. 6) for detecting the angular velocity around three axes of the controller 5 built therein.

The sub unit 76 is now explained with reference to FIG. 1 and FIG. 5. Note that FIG. 5 is a perspective view showing a status where the upper case (part of the housing 77) of the sub unit 76 has been removed.

The sub unit 76 includes a housing 77 formed, for example, via plastic molding. The housing 77 is of a size that can be gripped by an adult or a child using one hand.

A stick 78*a* serving as a direction designating means is provided to the top face of the housing 77. The stick 78*a* is an operational unit that outputs operational signals according to the tilting direction as a result of a tiltable stick protruding from the top face of the housing 77 being tilted. For example, the user can designate an arbitrary direction or position by tilting the tip of the stick in an arbitrary direction of 360°, and thereby command the moving direction of the user character or the like appearing in the virtual game world, or command the moving direction of the cursor. Note that an arrow key may be provided in substitute for the stick 78*a*.

A plurality of operation buttons (C button 78*d* and Z button 78*e*) are provided at the front face of the housing 77 of the sub unit 76. The operation buttons 78*d* and 78*e* are operational units that output operational signals assigned to the respective operation buttons 78*d* and 78*e* by the user pressing the button head. These operation buttons 78*d* and 78*e* are respectively assigned a function according to the game program that is executed by the game device 3.

A substrate is fixedly installed in side the housing 77, and the stick 78*a*, an acceleration sensor 761 and the like are provided on the main top face of the substrate. These components are connected to a connection cable 79 via a wiring (not shown) formed on the substrate and the like.

Figure 5:
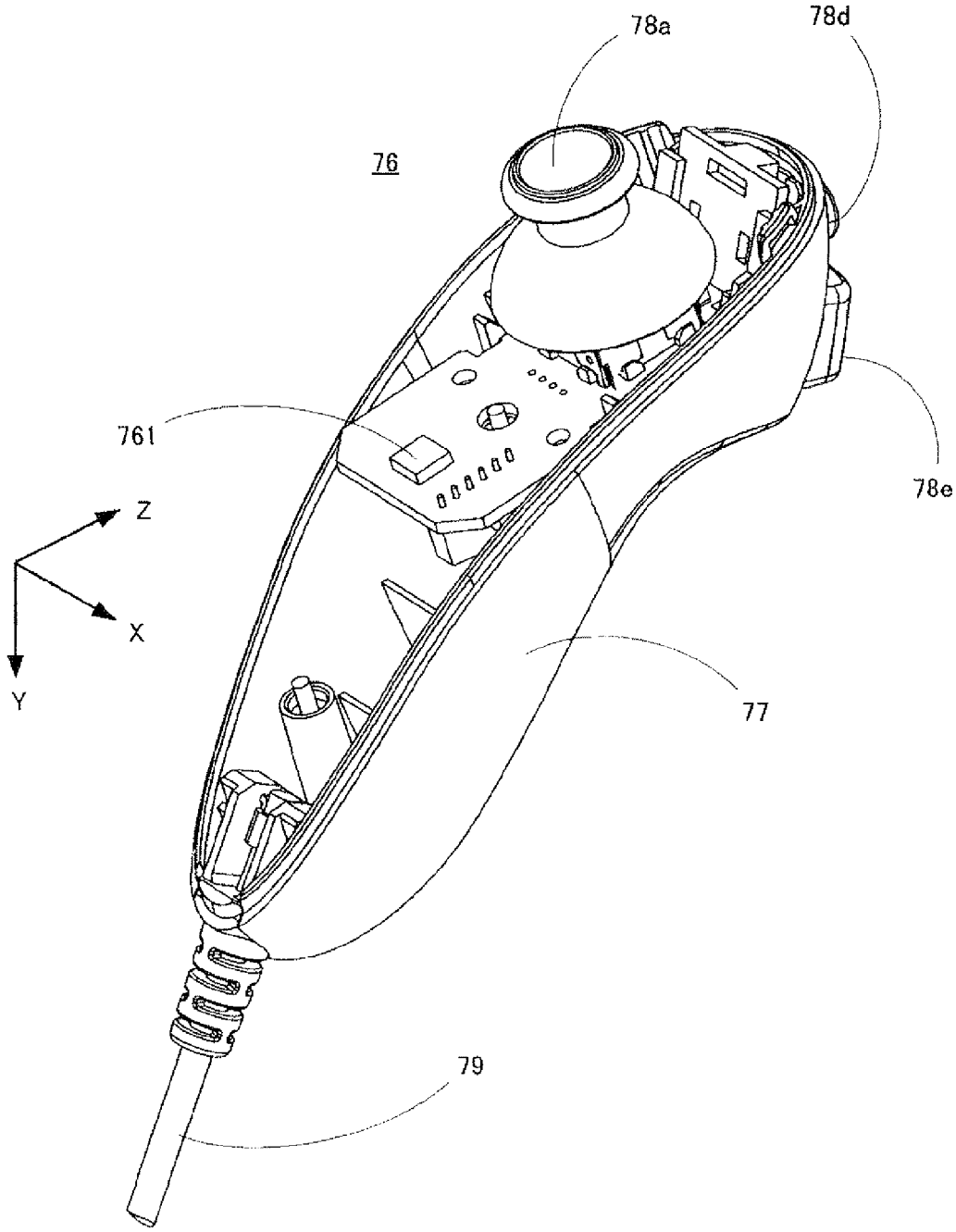
FIG. 5 is a perspective view showing the status where the upper case of the sub unit according to the embodiments is removed.

Note that the shape of the controller 5 and the sub unit 76, shape of the respective operation buttons, quantity and arrangement of sensors and vibrators shown in FIG. 3 to FIG. 5 are merely one example, and other shapes, quantities and arrangements may be used. Moreover, in this embodiment, although the imaging direction by the imaging means is the Z-axis normal direction, the imaging direction may be any direction. Specifically, the position of the imaging information arithmetic unit 35 (light incident face 35*a* of the imaging information arithmetic unit 35) in the controller 5 does not have to be the front face of the housing 31, and may be provided to any other face so as long as it can take in light from the outside of the housing 31.

Figure 6:
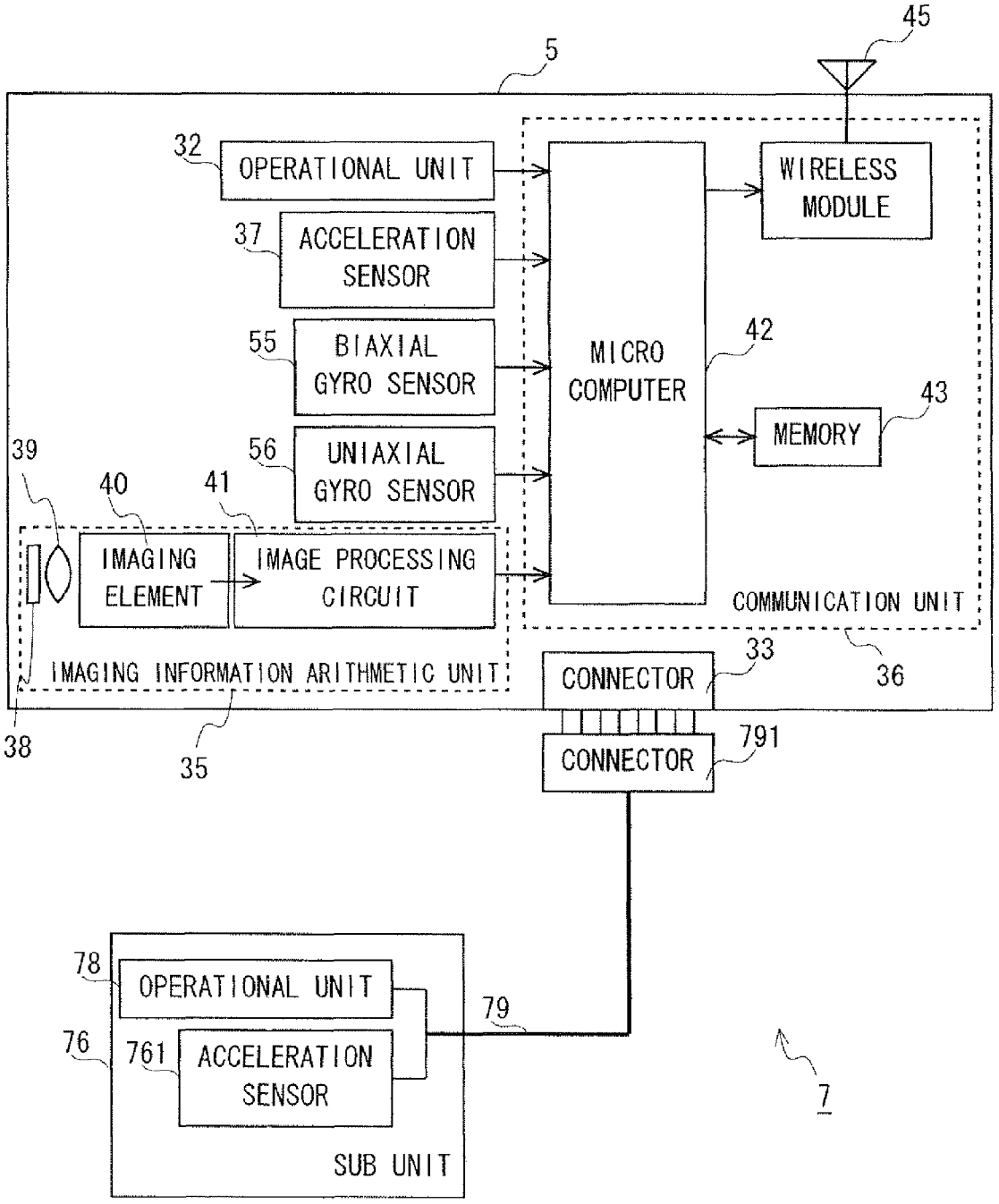
FIG. 6 is a block diagram showing the configuration of the input device according to the embodiments.

FIG. 6 is a block diagram showing the configuration of the input device 7 (controller 5 and sun unit 76). The controller 5 comprises an operational unit 32 (respective operation buttons 32*a* to 32*i*), a connector 33, an imaging information arithmetic unit 35, a communication unit 36, acceleration sensors 37, 761 and gyro sensors 55, 56. The controller 5 is used for sending, to the game device 3, operational data showing the contents of the operation that was performed to itself.

The operational unit 32 includes the respective operation buttons 32*a* to 32*i* described above, and outputs, to the microcomputer 42 of the communication unit 36, the operation button data showing the input status of the respective operation buttons 32*a* to 32*i* (whether the respective operation buttons 32*a* to 32*i* were pressed).

The imaging information arithmetic unit 35 is a system for analyzing the image data that was imaged by the imaging means and determining an area with high luminance, and calculating the center position, size and the like of such area. Since the imaging information arithmetic unit 35 has a maximum sampling frequency of, for example, roughly 200 frames/second, it can follow and analyze even relatively fast movements of the controller 5.

The imaging information arithmetic unit 35 includes an infrared filter 38, a lens 39, an imaging element 40, and an image processing circuit 41. The infrared filter 38 only allows the transmission of infrared light among the light entering from the front of the controller 5. The lens 39 focuses the infrared light that passed through the infrared filter 38 and causes it to enter the imaging element 40. The imaging element 40 is, for example, a solid imaging element such as a CMOS sensor or a CCD sensor, and outputs image signals upon receiving the infrared light that was focused by the lens 39. Here, the markers 6R and 6L of the marker unit 6 disposed in the vicinity of the display screen of the TV 2 are configured from infrared LEDs that output infrared light forward from the front of the TV 2. Accordingly, by providing the infrared filter 38, the imaging element 40 generates image data only by receiving the infrared that passed through the infrared filter 38, and it is there possible to more accurately capture the images of the markers 6R and 6L. The image that was captured by the imaging element 40 is hereinafter referred to as the captured image. The image data generated by the imaging element 40 is processed by the image processing circuit 41. The image processing circuit 41 calculates the position of the imaging targets (markers 6R and 6L) in the captured image. The image processing circuit 41 outputs the coordinates showing the calculated position to the microcomputer 42 of the communication unit 36. Data of these coordinates is sent by the microcomputer 42 to the game device 3 as operational data. The foregoing coordinates are hereinafter referred to as the "marker coordinates". Since the marker coordinates change in correspondence to the direction (inclination angle) or position of the controller 5 itself, the game device 3 can calculate the direction or position of the controller 5 by using the marker coordinates.

Note that, in the other embodiments, the controller 5 may be configured without the image processing circuit 41, and the captured image itself may be sent from the controller 5 to the game device 3. Here, the game device 3 may include a circuit or a program with the same function as the image processing circuit 41 to calculate the foregoing marker coordinates.

The acceleration sensor 37 detects the acceleration (including gravitational acceleration) of the controller 5; that is, detects the force (including gravity) that works on the controller 5. The acceleration sensor 37 detects the value of the acceleration (rectilinear acceleration) in the rectilinear direction along the sensing axis direction among the accelerations that are applied to the detection unit of the acceleration sensor 37. For example, in the case of a mu axial acceleration sensor of two axes or more, accelerations of the components along the respective axes are respectively detected as the accelerations that are being applied to the detection unit of the acceleration sensor. For example, a triaxial or biaxial acceleration sensor may be the type that is available from Analog Devices, Inc. or ST Microelectronics N.V. Note that the acceleration sensor 37 is, for example, a capacitance-type acceleration sensor, but acceleration sensors of other types may also be used.

In this embodiment, the acceleration sensor 37 detects the respective rectilinear accelerations concerning the triaxial direction including the vertical direction (Y-axis direction shown in FIG. 3), the horizontal direction (X-axis direction shown in FIG. 3) and the longitudinal direction (Z-axis direction shown in FIG. 3) with the controller 5 as the reference. Since the acceleration sensor 37 is used for detecting the acceleration concerning the rectilinear direction along the respective axes, the output from the acceleration sensor 37 represents the value of the rectilinear acceleration of each of the three axes. Specifically, the detected acceleration is represented as a three-dimensional vector (ax, ay, az) in the XYZ coordinate system (hereinafter referred to as the "controller coordinate system") that is set with the input device 7 (controller 5) as the reference. In the ensuing explanation, the vector that uses the respective values concerning the three axes detected by the acceleration sensor 37 as the respective components is referred to as the acceleration vector.

Data (acceleration data) showing the acceleration (acceleration vector) detected by the acceleration sensor 37 is output to the communication unit 36. Note that, since the acceleration detected by the acceleration sensor 37 changes in correspondence with the direction (inclination angle) and movement of the controller 5 itself, the game device 3 can calculate the direction and movement of the controller 5 by using the foregoing acceleration data.

The biaxial gyro sensor 55 and the uniaxial gyro sensor 56 detect the angular velocity around the three axes (in this embodiment, XYZ axis of the controller coordinate system), and send the data (angular velocity data) showing the detected angular velocity to the controller 5.

The biaxial gyro sensor 55 detects the angular velocity (per unit time) around the X-axis and the angular velocity (per unit time) around the Y-axis. Moreover, the uniaxial gyro sensor 56 detects the angular velocity (per unit time) around the Z-axis. Note that, in this specification, the rotating directions around the Z-axis, around the X-axis and around the Y-axis with the imaging direction (Z-axis normal direction) of the controller 5 as the reference are respectively referred to as the roll direction, the pitch direction, and the yaw direction. Specifically, the biaxial gyro sensor 55 detects the angular velocity of the pitch direction (rotating direction around the X-axis) and the yaw direction (rotating direction around the Y-axis), and the uniaxial gyro sensor 56 detects the angular velocity of the roll direction (rotating direction around the Z-axis).

Note that this embodiment adopts a configuration of using the biaxial gyro sensor 55 and the uniaxial gyro sensor 56 for detecting the angular velocity around the three axes, but in the other embodiments, there is no limitation in the quantity and combination of the gyro sensors so as long as it is possible to detect the angular velocity around the three axes.

Moreover, in this embodiment, the three axes for which the angular velocity is to be detected by the respective gyro sensors 55 and 56 are set to coincide with the three axes (XYZ axis) for which the acceleration is to be detected by the acceleration sensor 37. However, in the other embodiments, the three axes for which the angular velocity is to be detected by the respective gyro sensors 55 and 56 and the three axes for which the acceleration is to be detected by the acceleration sensor 37 do not have to coincide.

Data showing the angular velocity detected by the gyro sensors 55 and 56 is output to the microcomputer 54. Accordingly, data showing the angular velocity around the three axes of the XYZ axis is input to the microcomputer 54. The microcomputer 54 sends the foregoing data showing the angular velocity around the three axes as the angular velocity data to the controller 5 via a plug 53. Note that the sending of data from the microcomputer 54 to the controller 5 is performed intermittently for each predetermined cycle, but since the game processing is generally performed in units of 1/60 seconds (as one frame time), data is preferably sent in a cycle that is less than the foregoing time.

In this embodiment, the game device 3 determines the posture of the input device 7 (controller 5) based on the acceleration data and the angular velocity data. The posture of the input device 7 is represented, for example by coordinate values of the xyz coordinate system (hereinafter referred to as the "local coordinate system") with a predetermined position of a space where the input device 7 exists, as the reference. Here, as shown in FIG. 1, let it be assumed that the xyz coordinate system is a coordinate system in which, on the premise that the input device 7 is positioned in front of the marker unit 6, the direction facing the marker unit 6 from the position of the input device 7 is the z-axis normal direction, the vertical direction (opposite direction of the gravitational direction) is the y-axis normal direction, and the leftward direction when viewing the marker unit 6 from the position of the input device 7 is the x-axis normal direction. Moreover, here, the posture of the input device 7 when the X-axis, the Y-axis, and the Z-axis with the input device 7 (controller 5) as the reference respectively coincide with the x-axis, y-axis and z-axis directions is referred to as the reference posture. The posture of the input device 7 is the posture in the xyz coordinate system when the input device 7 is rotated respectively in the roll direction (around the Z-axis), the pitch direction (around the X-axis), and the yaw direction (around the Y-axis) with the Z-axis direction from the reference posture as the reference.

The communication unit 36 includes a microcomputer 42, a memory 43, a wireless module 44, and an antenna 45. The microcomputer 42 controls the wireless module 44 which wirelessly sends the data acquired by the microcomputer 42 to the game device 3 while using the storage area of the memory 43 upon performing the processing. Moreover, the microcomputer 42 is connected to the connector 33. Data sent from the sub unit 76 is input to the microcomputer 42 via the connector 33.

The sub unit 76 comprises the foregoing operational unit 78 and acceleration sensor 761, and is connected to the microcomputer 42 via the connection cable 79, the connector 791 and the connector 33. In addition, the operational signal (sub key data) from the operational unit 78 provided to the sub unit 76 and the acceleration signal (sub acceleration data) from the acceleration sensor 761 are output to the microcomputer 42 via the connection cable 79.

Returning to the explanation of the controller 5, data output from the operational unit 32, the imaging information arithmetic unit 35, the acceleration sensor 37, 761 and the gyro sensors 55, 56 to the microcomputer 42, and data sent from the sub unit 76 to the microcomputer 42 are temporarily stored in the memory 43. The foregoing data are sent as operational data to the game device 3. Specifically, the microcomputer 42 outputs the operational data stored in the memory 43 to the wireless module 44 when the timing of sending data to the wireless controller module 19 of the game device 3 arrives. The wireless module 44 uses, for example, the Bluetooth (registered trademark) technology to modulate the carrier wave of a predetermined frequency into operational data, and emits its weak radiowave signal from the antenna 45. In other words, the operational data is modulated into a weak radiowave signal by the wireless module 44 and then sent to the controller 5. The weak radiowave signal is received by the wireless controller module 19 of the game device 3. The game device 3 can acquire the operational data by demodulating or decoding the received weak radiowave signal. In addition, the CPU 10 of the game device 3 performs the game processing based on the acquired operational data and the game program. Note that the wireless transmission of data from the communication unit 36 to the wireless controller module 19 is performed intermittently for each predetermined cycle, but since the game processing is generally performed in units of 1/60 seconds (as one frame time, data is preferably sent in a cycle that is less than the foregoing time. The communication unit 36 of the controller 5 outputs the respective operational data to the wireless controller module 19 of the game device 3 at a ratio of once per 1/200 seconds.

[Outline of Game Processing]

Outline of the game that is executed by the game system 1 is now explained with reference to FIG. 7 and FIG. 8.

Figure 7:
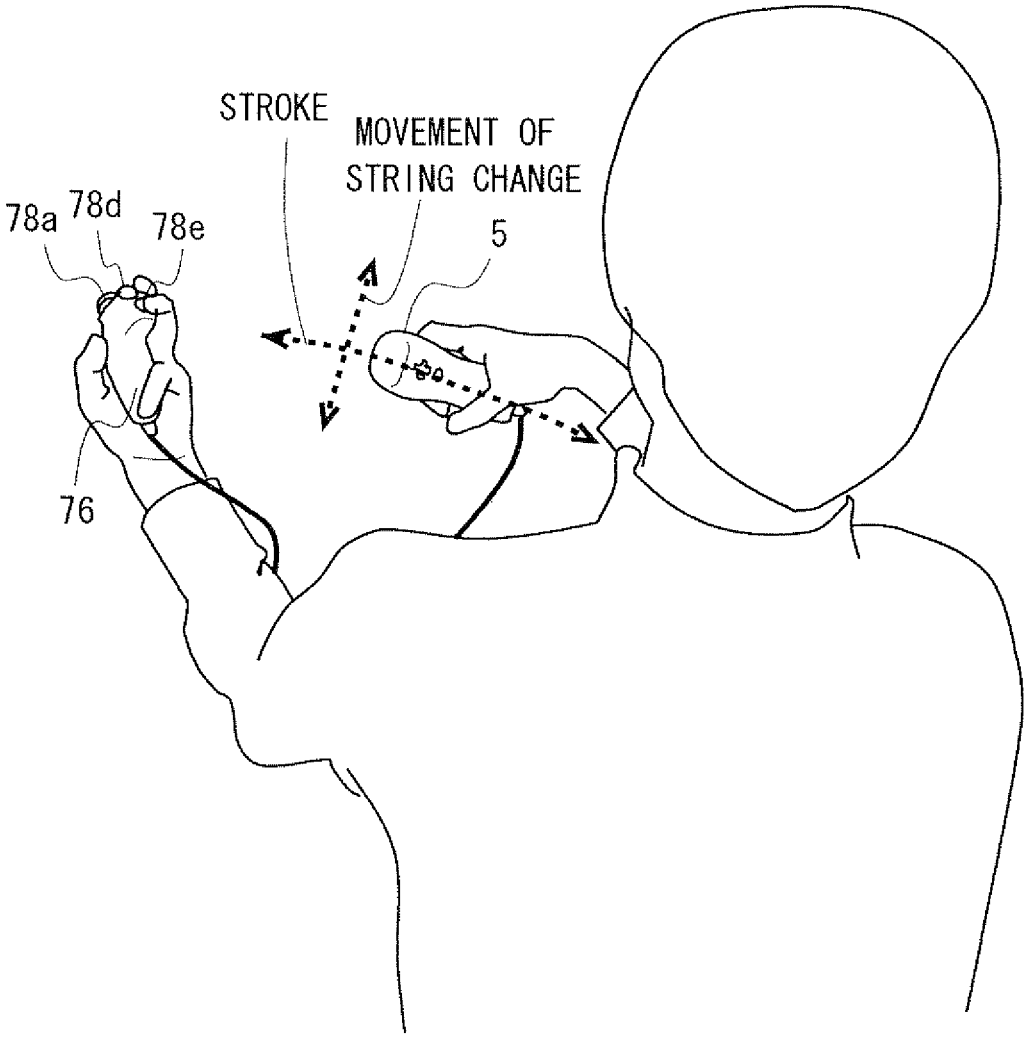
FIG. 7 is a diagram schematically explaining the status when operating the game using the input device according to the embodiments.

FIG. 7 is a schematic diagram showing the operation method of the input device 7 by the user upon using the simulation function of a violin provided by the game system 1 according to this embodiment. With the game executed in this embodiment, as a part of the game processing, provided is a simulation function of a violin for outputting sound according to the operations by the user. The user can output sound from the speaker 2*a* according to the operation, as though he/she is actually playing the violin, by portraying the controller 5 as a violin bow and operating the controller 5. In other words, in this embodiment, the controller 5 becomes a virtual bow. Then, the various sensor built into the controller 5 detects the bowing operation of frictioning (stroking) the virtual strings by using the controller 5 as the virtual bow, the posture variation per unit time, and the volume parameter according to the posture variation is thereby decided. The bowing operation includes the movement of stroking and changing strings of moving the controller 5 in the directions shown in FIG. 7. Note that, with a bow-drawn stringed instrument such as a violin, the performer normally plays the instrument by consciously moving the bow perpendicularly to the strings, but since in reality a rotational motion is detected, the movement of the bow can be detected based on the posture variation or angular velocity of the controller 5 as the virtual bow.

Moreover, in this embodiment, the bowing operation is detected by the various sensors built into the controller 5 and the operation of string changing is detected, and the user can perform the string changing with a feeling as through he/she is performing the string changing with an actual violin. Moreover, in this embodiment, the sub unit 76 serves, as a virtual fingerboard, and the user can change the pitch with a feeling as though he/she is pressing the strings of an actual violin based on the pressed state of the buttons 78*a*, 78*d* and 78*e* provided to the sub unit 76 as the virtual fingerboard.

Figure 8:
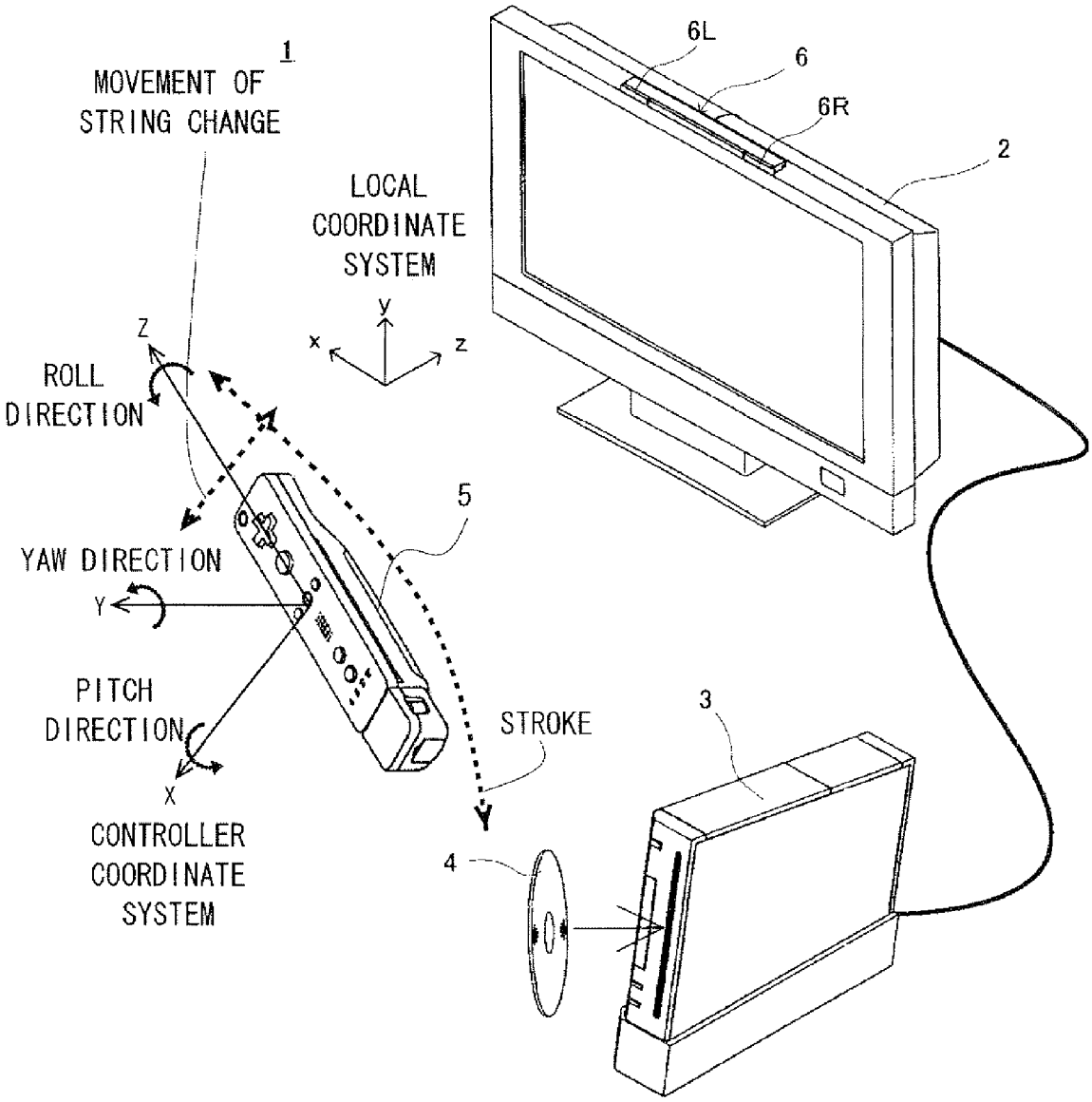
FIG. 8 is a schematic diagram showing the local coordinate system that is used upon utilizing the simulation function of the violin according to the embodiments and the movement of the controller coordinate system in relation thereto.

FIG. 8 is a schematic diagram showing the local coordinate system (xyz coordinate system) that is used upon utilizing the simulation function of the violin according to this embodiment and the movement of the controller coordinate system (XYZ coordinate system) in relation thereto. In this embodiment, the controller 5 is gripped by the user in a state where the front face of the controller 5 (Y-axis direction) is facing the user side (in other words, state of being rolled approximately 90 degrees in advance). Thus, the operation of the user gripping the controller 5 and stroking the controller 5 with the user's body as the axis is mainly detected as the operation in the pitch direction, and the string changing operation of the user gripping the controller and tilting the end of the controller 5 vertically is detected as the operation in the yaw direction (circumferential direction with the direction that the violin strings are stretched as the axis). In this embodiment, the movement of this kind of stroke becomes the operation in the pitch direction as described above. Thus, the movement of strokes can be expresses as the movement in which the posture of the Y-axis and Z-axis of the controller coordinate system changes relative to the local coordinate system. Moreover, as described above, since the controller 5 is gripped by the user in a state of being rolled approximately 90 degrees in advance, the movement of strokes becomes the movement that mainly reflects the x component and z component in the local coordinate system (refer to the correspondence of the controller coordinate system and the local coordinate system shown in FIG. 8). Thus, in the volume update processing described later with reference to FIG. 15, the respective posture variations of the Y-axis and Z-axis of the controller coordinate system are represented using the x component and z component in the local coordinate system (refer to the posture variations dirY_x, dirY_z, dirZ_x and dirZ_z described later).

[Functional Configuration of Game Device]

Figure 9:
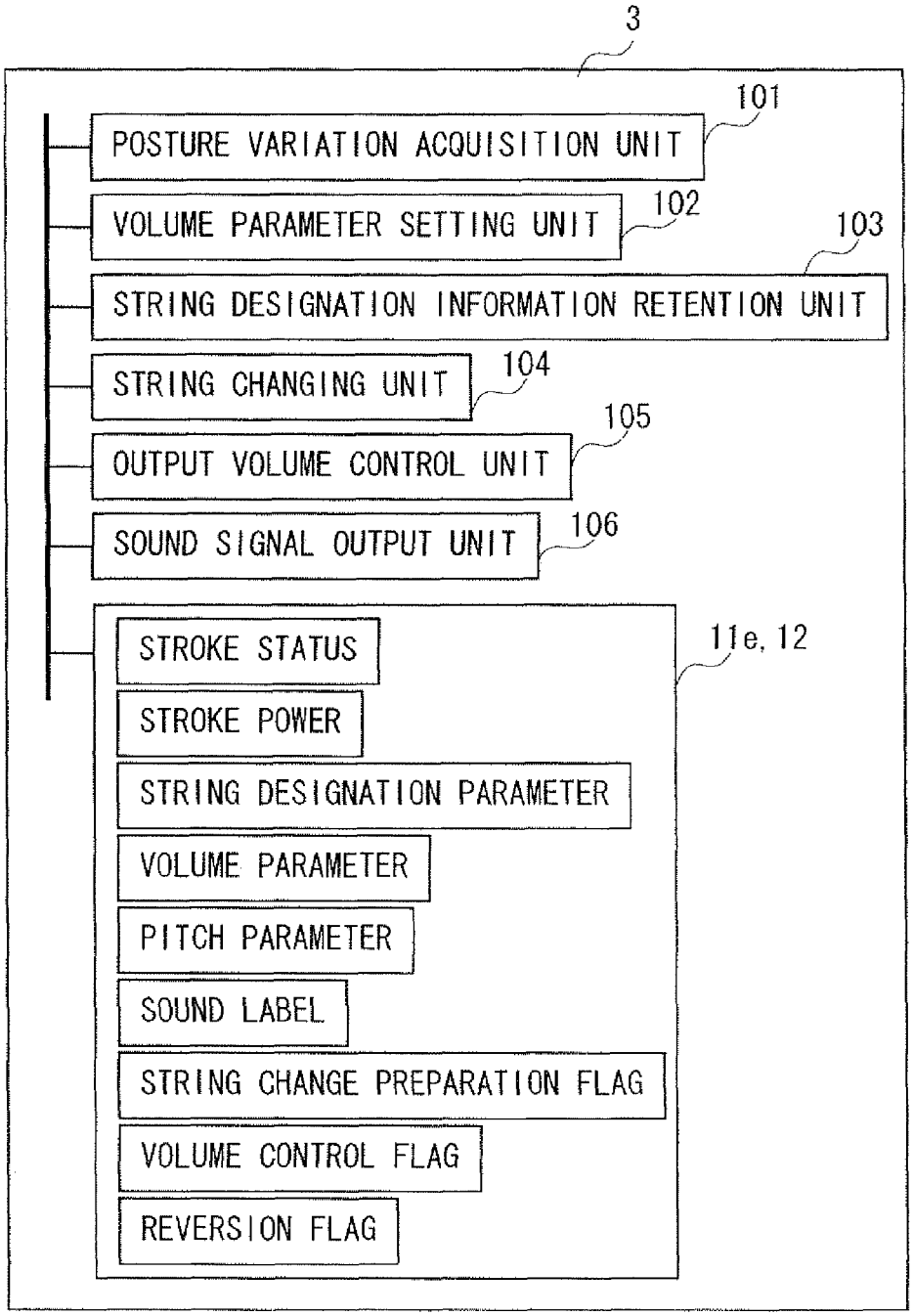
FIG. 9 is a diagram showing the functional configuration and data configuration of the game device according to the embodiments.

FIG. 9 is a diagram showing the functional configuration and the data configuration of the game device 3 according to this embodiment. The respective functional units shown in FIG. 9 (posture variation acquisition unit 101 volume parameter setting unit 102, string designation information retention unit 103, string changing unit 104, output volume control unit 105 and sound signal output unit 106) are, for example, a part of the functions that are realized by the CPU 10, the DSP 11*c*, the GPU 11*b* and the like reading and executing the game program stored in the optical disk 4 and extracting it into the internal main memory 11*e* or the external main memory 12. In other words, the game device 3 according to this embodiment operates as the musical performance apparatus according to the present invention which simulates a sounding device by executing the game program.

The posture variation acquisition unit 101 acquires the posture variation per unit time of the controller 5 by calculating the variation per unit time (per frame in this embodiment) of the X-axis, Y-axis and Z-axis serving as the reference showing the posture of the controller 5 relative to the local coordinate system (xyz coordinate system) defined the real space based particularly on data (measurement information) concerning the movement of the controller 5 among the operational data. Here, the posture variation acquisition unit 101 acquires a plurality of posture variations that are broken down for each combination of the axes of the local coordinate system (X-axis and Z-axis in this embodiment) and the axes serving as the reference showing the posture of the controller 5 (Y-axis and Z-axis in this embodiment). Details concerning the calculated posture variations will be described later.

Note that, in this embodiment, the posture variation acquisition unit 101 acquires the average value of the posture variations acquired within a predetermined period (16 frames in this embodiment) as the posture variation to be referred to for setting the volume parameter. Note that, in this embodiment, consideration of the fact that variations will occur in the measurement values acquired from the gyro sensors 55, 56, the average value of the posture variations is calculated and referred to, but the posture variation to be referred is not limited to the average value.

The volume parameter setting unit 102 sets the volume parameter for deciding the volume of producing sound from the sounding device according to the posture variation per unit time (frame). The volume parameter setting unit 102 acquires and sets the volume parameter according to the posture variation by referring to a map that prescribes the correspondence of the posture variation and the volume parameter. Note that the map representing the relationship of the posture variation and the volume parameter will be described later with reference to FIG. 16. However, the volume parameter may also be calculated using a relational expression prescribing the correspondence of the posture variation and the volume parameter. Specifically, the posture variation acquisition unit 101 and the volume parameter setting unit 102 set the volume parameter by executing the volume update processing described later with reference to FIG. 15.

Note that, in this embodiment, the volume parameter setting unit 102 sets the volume parameter based on two or more posture variations in descending order of value among the plurality of posture variations acquired by the posture variation acquisition unit 101.

The string designation information retention unit 103 retains a string designation parameter which designates a string that is currently the target to be sounded. Then, the string changing unit 104 changes the string designated by the string designation parameter when it is determined that the angular acceleration to the circumferential direction (yaw direction of the controller) centering on the string has exceeded the threshold based on the operational data. Specifically, the string changing unit 104 changes the string designated by the string designation parameter by executing the designated string update processing described later with reference to FIG. 12A and FIG. 12B.

The output volume control unit 105 stops the output of the sound signal by the sound signal output unit 106 for a predetermined time or lowers the output volume of the sound signal by the sound signal output unit 106 when it is determined, based on the operational data, that the positive and negative of angular acceleration in the pitch direction have inverted. As a result of the above, when the user performs the reversion operation, the output of sound is once stopped or the volume is lowered. A "reversion operation" is an operation that is performed in order to switch the direction of the stroke when performing the reciprocal stroke operation of the stringed instrument. Normally, when the reversion operation is performed, since the user decelerates for ending the stroke in the direction that was performed up to then, the positive and negative of the angular acceleration are inverted. In other words, according to this embodiment, since the reversion performed by the user is detected and the output of sound is once stopped or the volume is lowered, the user can experience a sensation as though actually playing the violin. Specifically, the output volume control unit 105 performs the output volume control during the reversion operation by executing the bowing update processing described later with reference to FIG. 14A and FIG. 14B and the sound signal output processing described later with reference to FIG. 17.

Note that, as described above, in this embodiment, the controller 5 is gripped by the user in a state of being rolled approximately 90 degrees in advance (refer to FIG. 8). Then, the string will be substantially horizontal when the violin is set up normally, and the bow engages in a rotational motion with the user's body as the axis during the stroke. Thus, in this embodiment, the reversion operation is detected based on the positive and negative of the angular acceleration to the pitch direction. However, since the setup and rotating direction of the bow will differ depending on the bow-drawn stringed instrument as the simulation target, the rotating direction used for determining the inversion of positive and negative in detecting the reversion operation can be set as needed according to the simulation target.

The sound signal output unit 106 outputs sound signals of the volume according to the settings of the volume parameter and the like. Specifically, the sound signal output unit 106 outputs sound signals of the volume according to the settings of the volume parameter and the like by executing the sound signal output processing described later with reference to FIG. 17.

[Data Configuration of Game Device]

The various data used in the simulation processing according to this embodiment are now explained with reference to FIG. 9. The internal main memory 11*e* or the external main memory 12 retains various data such as the stroke status, stroke power, string designation parameter, volume parameter, pitch parameter, sound label and the like.

The stroke status is information showing the status of the stroke by the user. Bowing of the violin includes an UP stroke and a DOWN stroke. In this embodiment, in the posture shown in FIG. 7 and FIG. 8, the stroke of the user pulling one's hand gripping the controller 5 closing to one's body is referred to as the UP stroke, and the stroke of the user pushing one's hand gripping the controller 5 away from one's body is referred to as the DOWN stroke. A violin is played by alternately repeating the UP stroke and the DOWN stroke. As the stroke status, set may be, in addition "no stroke" as the value for initialization, "UP stroke," "DOWN stroke," "UP to DOWN stroke" and "DOWN to UP stroke" can be set as the current stroke status. Here, the UP to DOWN stroke is the stroke status that is set while the stroke status is moving from the UP stroke to the DOWN stroke, and the DOWN to UP stroke is the stroke status that is set while the stroke status is moving from the DOWN stroke to the UP stroke. The stroke status is initialized with "no stroke" in the initialization processing described later.

The stroke power is information that is referred to upon setting the tone of the sounding device (violin in this embodiment) as the simulation target. In the embodiment, by reproducing the sound label according to the stroke power, it possible to output sound signals with a tone according to the force of the bowing stroke. The stroke power can be set as "weak" or "strong." The stroke power is initialized as "weak" in the initialization processing described later.

The string designation parameter is information showing which string among the four strings of the violin is the target to be sounded (in other words, which string is being played by the virtual bow). Since the violin is drawn with a G string, a D string, an A string, and an E string in order from the low pitch string, information capable of identifying the four strings is set as the string designation parameter. Note that, in this embodiment, the string designation parameter uses 0 (zero) as the value showing the G string, 5 as the value showing the D string, 10 as the value showing the A string, and 15 as the value showing the E string. Thus, by adding 5 to the string designation parameter, the string is changed to the next higher pitch string, and, by subtracting 5 from the string designation parameter, the string is changed to the next lower pitch string. However, other methods such as using a flag or the like showing the respective strings can also be adopted as the method of designating the respective strings in the string designation parameter. The string designation parameter is initialized with the value ("10" in this embodiment) showing the A string in the initialization processing described later.

The volume parameter is information for designating the volume of sound signals to be output. In this embodiment, the volume parameter can take on a value between 0.0000 showing silence to 1.0000 showing the maximum volume. The volume parameter is initialized with 0.0000 (silent) in the initialization processing described later.

The pitch parameter is information for designating the pitch of sound signals to be output. Moreover, in this embodiment, the pitch parameter is a value in which 1 is added for each half step up and in which 1 is subtracted for each half step down with the pitch (440 or 442 Hz) in the case of sounding the A string of the violin as an open string as 0 (zero). The pitch parameter is initialized with 0 (zero) in the initialization processing.

The sound label is data of a sound waveform for deciding the tone of sound to be output from the game device 3. As the sound label, set can be a sound waveform for representing a tone corresponding to a "weak" stroke power and a sound waveform for representing a tone corresponding to a "strong" stroke power. The sound label is initialized with a sound label corresponding to the "weak" stroke power in the initialization processing described later.

In addition, the internal main memory 11*e* or the external main memory 12 retains various flags including a string change preparation flag, a volume control flag and a reversion flag. The string change preparation flag is a flag for showing whether it is the preparatory stage of the string changing. The volume control flag is a flag that is referred to in the sound signal output processing for implementing the effect of lowering the volume during the reversion operation. Moreover, the reversion flag is a flag for showing that the reversion operation was detected during the stroke. The various flags are initialized with OFF in the initialization processing described later.

<Processing Flow>

The flow of processing executed in this embodiment is now explained with reference to the flowcharts. Note that the specific contents and the processing routine of the processing shown in the flowcharts according to this embodiment are an example for working the present invention. The specific processing contents and the processing routine may be suitably selected according to embodiments of the present invention.

[Simulation Processing]

Figure 10:
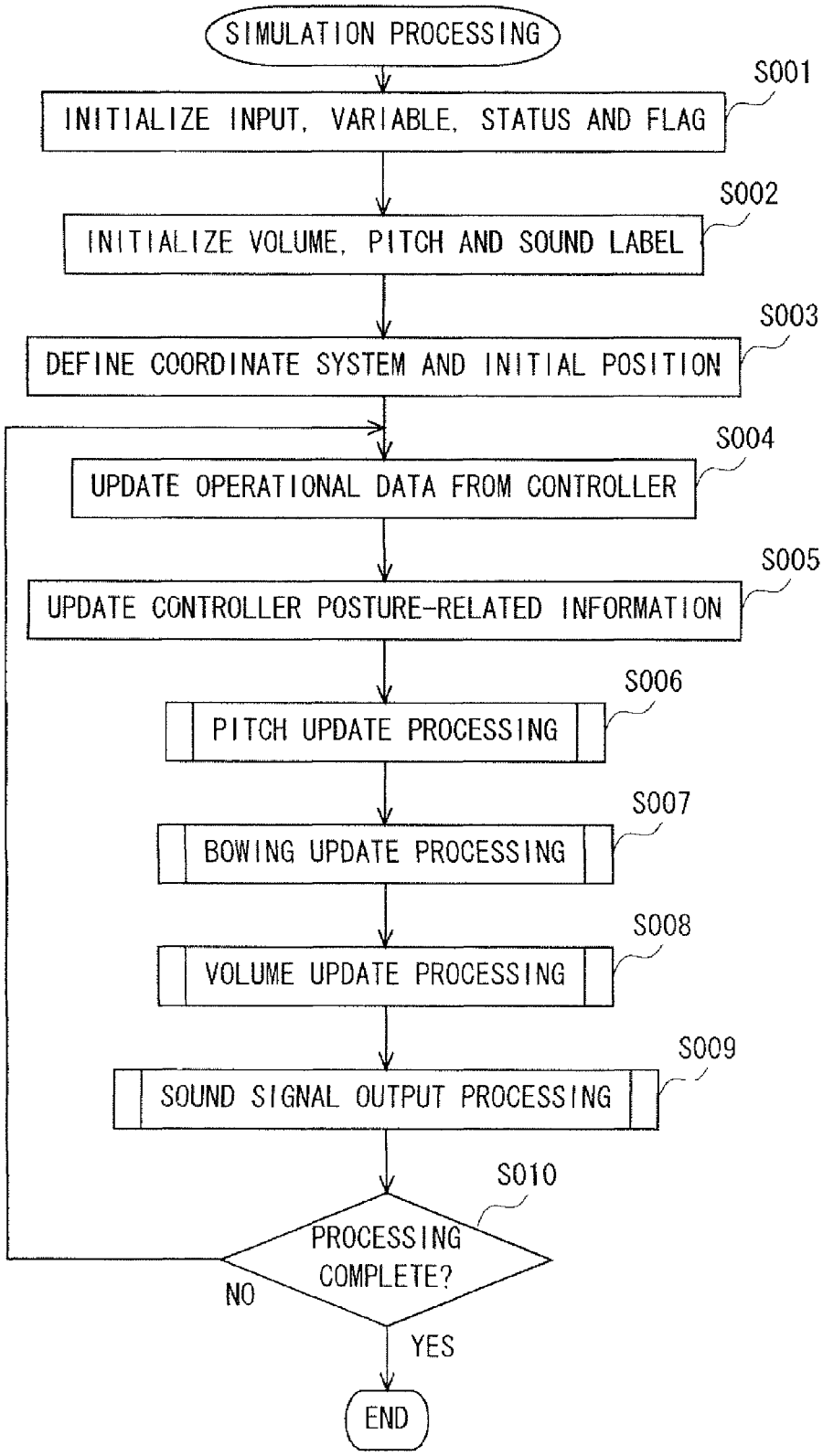
FIG. 10 is a flowchart showing the flow of the simulation processing according to the embodiments.

FIG. 10 is a flowchart showing the flow of the simulation processing according to this embodiment. The simulation processing according to this embodiment is executed as a part of the game based on the game program that is executed by the game device 3.

In step S002 to step S003, the initialization processing is performed. The CPU 10 initializes the operational data, various variables to be used in this simulation processing, information for managing the execution status of this simulation processing, and the various flags used in this simulation processing recorded in the buffer area of the internal main memory 11*e* or the external main memory 12 (step S001). Moreover, the CPU 10 initializes the volume parameter, the pitch parameter and the sound label which are referred to upon generating the sound signals to be output in this simulation processing (step S002). The explanation of the specific contents of initialization is omitted since it has been previously described in the explanation of the data configuration.

In addition, the game device 3 leads the user to take the posture of playing the violin while portraying the controller 5 as a bow. When the user takes the posture of playing the violin (refer to FIG. 7), the CPU 10 defines the local coordinate system to serve as the reference showing the positional posture in the real space with the controller position as the initial position, and acquires the correspondence of the local coordinate system and the controller coordinate system showing the positional posture of the controller 5 (step S003). The correspondence of the local coordinate system and the controller coordinate system can be calculated based on the operational data acquired from the controller 5. The processing thereafter proceeds to step S004.

Note that the processing shown in this flowchart is the simulation processing of a violin which outputs sound signals according to the operational data by being repeatedly executed in frame units divided by 60 frames/second. Thus, the processing from step S004 to step S009 explained below is executed for each frame.

In step S004, the operational data input from the controller 5 is updated. The CPU 10 acquires the operational data from the various sensors provided to the controller 5 including the status of the respective operation buttons 32*a* to 32*i*, 78*e*, 78*d* and the stick 78*a* provided to the controller 5 and the sub unit 76, the marker coordinates calculated by the image processing circuit 41, the acceleration detected by the acceleration sensor 37, and the angular velocity measured using the gyro sensors 55, 56, and thereby updates the buffer area of the internal main memory 11*e* or the external main memory 12. The processing thereafter proceeds to step S005.

In step S005, the information (hereinafter referred to as the "posture-related information") relating to the three-dimensional posture of the controller 5 is updated. The CPU 10 calculates the three-dimensional posture of the controller 5 relative to the local coordinates and the respective angular accelerations and angular acceleration variations of the yaw direction, the pitch direction, and the roll direction of the controller 5 based on the input contents (operational data) from the controller 5 which were updated in step S004, and thereby updates the posture-related information of the controller 5 retained in the memory. For example, the CPU 10 calculates the respective angular accelerations and angular acceleration variations of the yaw direction, the pitch direction, and the roll direction based on the respective angular velocities of the yaw direction, the pitch direction, and the roll direction of the controller 5 which were acquired and updated by the gyro sensors 55, 56. Note that the angular accelerations and the angular velocity variations can also be calculated based on only the angular velocities acquired from the gyro sensors 55, 56, and may also be corrected by using the information and the like acquired from the acceleration sensor 37. The processing thereafter proceeds to step S006.

In step S006, the pitch update processing is executed. The CPU 10 updates the pitch parameter for designating the pitch of sound signals to be output based on the operational data that was updated in step S004 and the posture-related information that was updated in step S005. The specific contents of the pitch update processing will be described later with reference to the flowcharts shown in FIG. 11 to FIG. 13. The processing thereafter proceeds to step S007.

In step S007, the bowing update processing is executed. The CPU 10 updates the stroke status showing the status of the user's hand movement in the performance of the stringed instrument and the volume control flag associated with the reversion based on the operational data that was updated in step S004 and the posture-related information that was updated in step S005. The specific contents of the bowing update processing will be described later with reference to the flowchart shown in FIG. 14A and FIG. 14B. The processing thereafter proceeds to step S008.

In step S008, the volume update processing is executed. The CPU 10 updates the volume parameter for designating the volume of sound signals to be output based on the operational data that was updated in step S004 and the posture-related information that was updated in step S005. The specific contents of the volume update processing will be described later with reference to the flowchart shown in 15. The processing thereafter proceeds to step S009.

In step S009, the sound signal output processing is executed. The CPU 10 generates and outputs sound signals based on the various types of information which were set in the processing from step S006 to step S008. The specific contents of the sound signal output processing will be described later with reference to the flowchart shown in FIG. 17.

When the sound signal output processing shown in step S009 is complete, the processing thereafter proceeds to step S010. In step S010, whether the simulation processing shown in this flowchart is complete is determined, and the processing shown in this flowchart is ended when it is determined that the simulation processing is complete. Meanwhile, when it is determined that the simulation processing is not complete, the processing proceeds to step S004. In other words, with the simulation processing according to this embodiment, the processing from step S004 to step S009 is repeatedly executed until an end command or the like is received from the user. Note that, as described above, the processing from step S004 to step S009 of this flowchart is executed for each frame.

Details concerning the pitch update processing, the bowing update processing, the volume update processing, and the sound signal output processing shown in step S006 to step S009 of FIG. 10 are now explained with reference to the flowcharts of FIG. 11 to FIG. 17.

[Pitch Update Processing]

Figure 11:
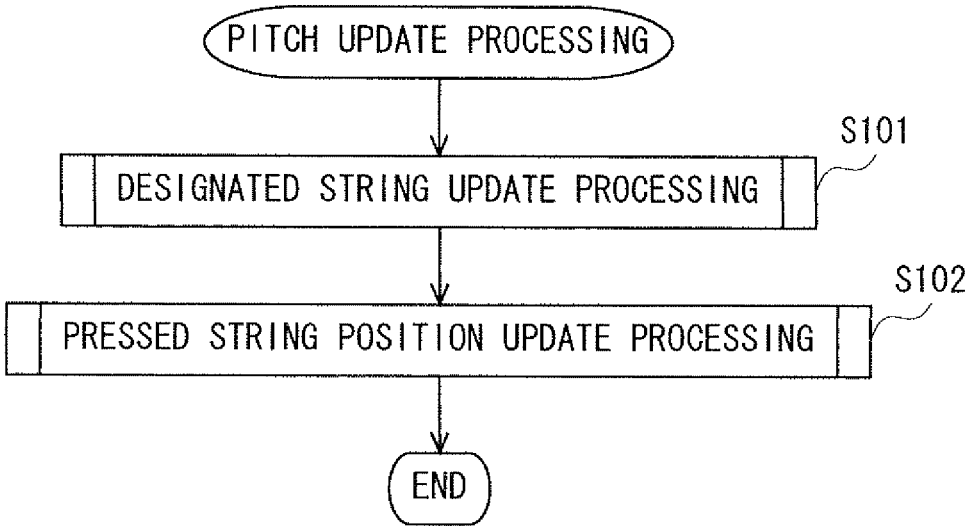
FIG. 11 is a flowchart showing the flow of the pitch update processing according to the embodiments.

FIG. 11 is a flowchart showing the flow of the pitch update processing according to this embodiment. The pitch update processing according to this embodiment includes the designated string update processing and the pressed string position update processing. In the designated string update processing, the CPU 10 updates the string designation parameter showing which string among the four strings of the violin is the target to be sounded based on the movement and the like of the controller 5 detected by using the gyro sensors 55, 56 and the like (step S101). Then, in the pressed string position update processing, the CPU 10 updates the pitch parameter upon determining which position of the string that is the target to be sounded is being pressed based on the pressed state and the like of the buttons of the sub unit 76 showing the pressed string position (step S102). The processing shown in this flowchart is thereafter ended. Note that the details of the designated string update processing will be described later with reference to FIG. 12A and FIG. 12B, and the details of the pressed string position update processing will be described later with reference to FIG. 13.

Figure 12A:
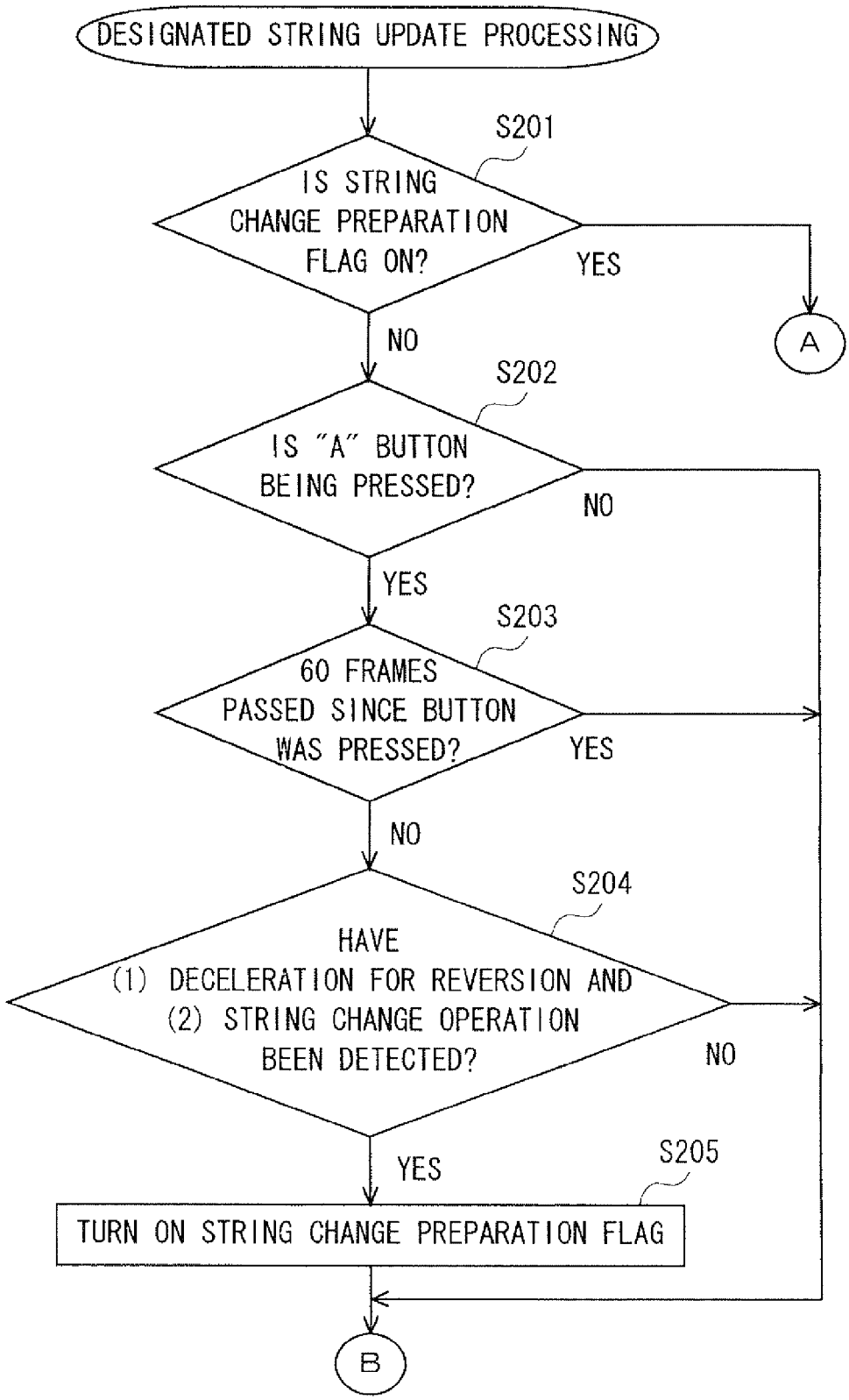
FIG. 12A is a flowchart A showing the flow of the designated string update processing according to the embodiments.
Figure 12B:
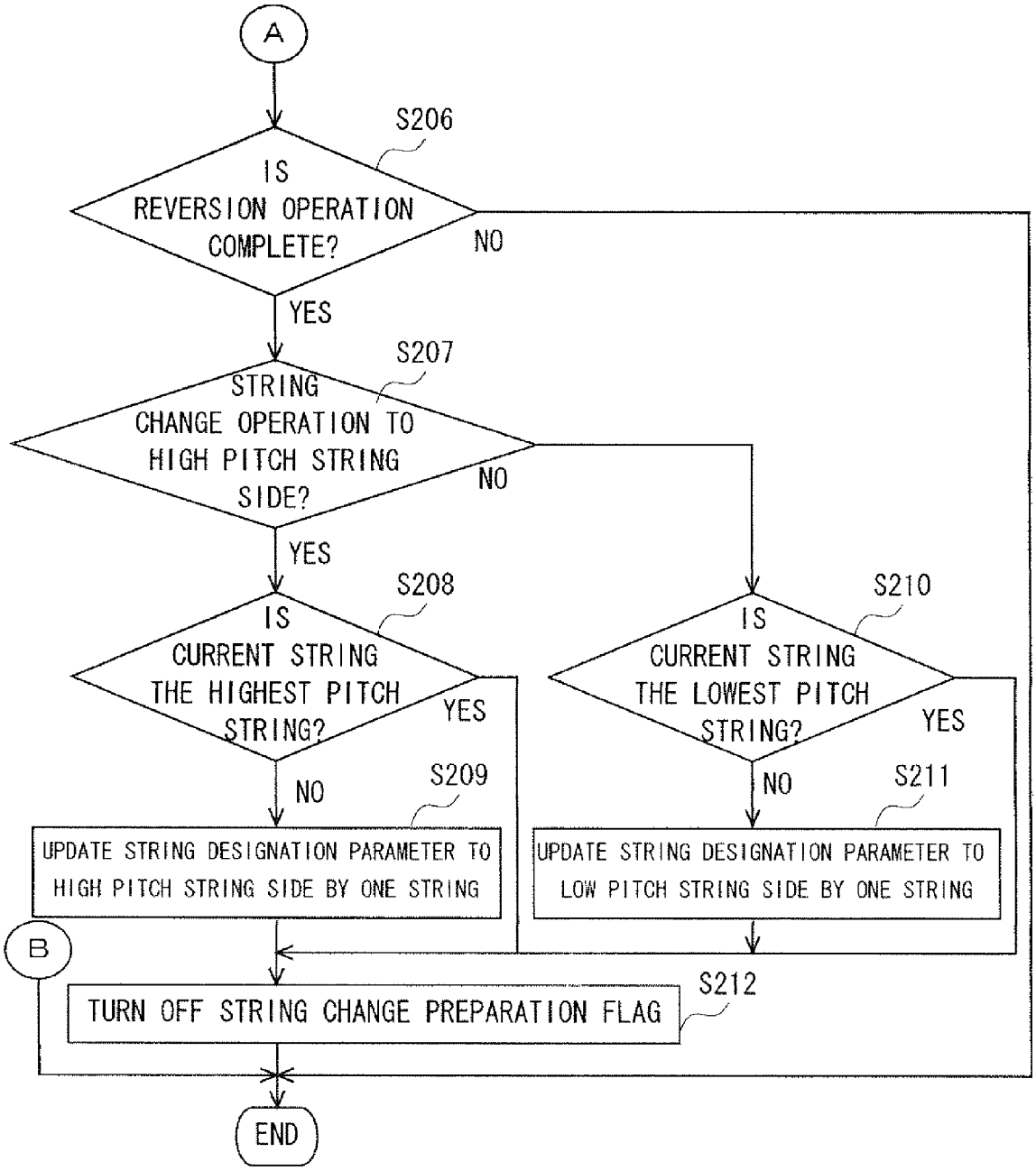
FIG. 12B is a flowchart B showing the flow of the designated string update processing according to the embodiments.

FIG. 12A and FIG. 12B are flowcharts showing the flow of the designated string update processing according to this embodiment.

In step S201, the status of the string change preparation flag is determined. The CPU 10 determines whether the current status the preparatory stage of string changing by referring to the string change preparation flag. When the string change preparation flag is OFF, the processing proceeds to step S202. When the string change preparation flag is ON, the processing proceeds to step S206.

As described above, the string change preparation flag is a flag for showing whether it is the preparatory stage of string changing. In this embodiment, when a movement that suggests string changing by the user is detected, a preparatory stage of string changing is provided by using the string change preparation flag without immediately performing string changing. When an actual violin is played, the timing that the sound produced by the string changing is changed is the timing that the stroke after the string changing is started, and the flow of sound production will become unnatural if the sound is immediately changed when the movement of string changing by the user is detected. Thus, in this embodiment, in order to enable the user to experience a feel where the sound production is started naturally at the timing when the reversion stroke after the string changing is started, only the preparation of the string changing (string change preparation flag is ON) at the timing where the movement of string changing is detected, and the sound to be produced is changed from the subsequent frame onward.

In step S202 and step S203, whether pressed state of the A button 32*d* has continued for a predetermined number of frames or more is determined. Upon the determination that the string change preparation flag is OFF in step S201, the CPU 10 determines whether the A button 32*d* is of a pressed status by referring to the operational data that was updated in step S004 of the simulation processing (step S202). When it is determined that the A button 32*d* is not being pressed, the processing shown in this flowchart is ended. Moreover, when it is determined that the A button 32*d* is being pressed, the CPU 10 refers to the number of continuous frames of pressed state which shows for how many frames the current pressed state has continued, and determines whether the pressed state of the A button 32*d* is continuing for a predetermined number of frames or more by comparing it with a predetermined threshold (for example, 60 frames) (step S203). More specifically, the number of continuous frames of pressed state of the A button 32*d* is measured by using methods such as preparing a counter which is incremented by one for each frame while the pressed state of the A button 32*d* is continuing as the counter that is prepared in the internal main memory 11*e* or the external main memory 12. This counter is initialized to 0 (zero) at the time that the pressed state of the A button 32*d* is released. When it is determined that the pressed state of the A button 32*d* is continuing for a predetermined number of frames or more, the processing shown in this flowchart is ended. Meanwhile, when it is determined that the pressed state of the A button 32*d* is not continuing for a predetermined number of frames or more, the processing proceeds to step S204.

In other words, in this embodiment, the user's unintended string changing is prevented by executing the string changing processing only when the A button 32*d* is being pressed (step S202). However, if the A button 32*d* is pressed for a predetermined time or longer, it is determined that the user is continuously pressing the A button 32*d* (erroneous operation), and the string changing processing is not executed even if the A button 32*d* is pressed (step S203). Note that the operation of expressly permitting string changing (operation of pressing the A button 32*d* in this embodiment) may be omitted. If the operation of expressly permitting string changing is omitted, a simulation that is closer to reality can be provided to the user since the string changing is executed only based on the movement of the controller 5.

In step S204, whether the user is performing movement for string changing is determined based on the movement of the controller 5. By referring to the angular acceleration variation of the pitch direction and the angular acceleration of the controller 5 in the yaw direction which were updated in step S005 of the simulation processing, the CPU 10

(1) determines whether the positive and negative of the angular acceleration variation of the pitch direction have been inverted in comparison to the previous frame, and (2) determines whether the angular acceleration of the yaw direction has reached a predetermined range.

In this embodiment, (1) by determining whether the positive and negative of the angular acceleration variation of the pitch direction have been inverted in comparison to the previous frame, the user's movement of decelerating for reversion is detected, and (2) by determining whether the angular acceleration of the yaw direction has reached a predetermined range, the user's movement of changing strings is detected. In the determination of whether the angular acceleration of the yaw direction has reached a predetermined range, for example, it is determined that the operation for changing strings to a higher pitch string is being performed when the angular acceleration of the yaw direction becomes −0.5 or less. Meanwhile, it is determined that the operation for changing strings to a lower pitch string is being performed when the angular acceleration of the yaw direction becomes 0.3 or more.

Here, if it is determined that the positive and negative of the angular acceleration variation of the pitch direction have been inverted in comparison to the previous frame and that the angular acceleration of the yaw direction has reached a predetermined range, the CPU 10 determines that the user is performing movement for string changing. When it is determined that the user is performing movement for string changing, the processing proceeds to step S205. When it is determined that the user is not performing movement for string changing, the processing shown in this flowchart is ended.

In step S205, the string change preparation flag is turned ON. The CPU 10 turns ON the string change preparation flag upon the determination that the user is performing movement for string changing in step S204. The processing shown in this flowchart is thereafter ended. When the designated string update processing shown in this flowchart is executed in the subsequent frame as a result of the string change preparation flag being turned ON in this step, the processing proceeds to step S206 in the determination shown in step S201, and the actual string changing (processing for updating the string designation parameter) is executed.

In step S206, whether the user's reversion operation associated with the string changing is complete is determined. Upon the determination that the string change preparation flag is ON in step S201, the CPU 10 refers to the angular acceleration of the controller 5 in the pitch direction which was updated in step S005 of the simulation processing and thereby determines whether the reversion operation associated with the string changing is complete. More specifically, the CPU 10 determines that the reversion operation is complete when the angular acceleration of the controller 5 in the pitch direction is within a predetermined range including 0 (zero). Meanwhile, the CPU 10 determines that the reversion operation is not yet complete (still performing reversion operation) when the angular acceleration of the controller 5 in the pitch direction is not within a predetermined range including 0 (zero). When it is determined that the user's reversion operation is complete, the processing proceeds to step S207. When it is determined that the user's reversion operation is not complete, the processing shown in this flowchart is ended.

In other words, with the designated string update processing according to this embodiment, the actual string changing is not performed until the user's reversion operation is complete even after the user's movement of string changing is detected and the string change preparation flag is turned ON. As a result of the above, the user can experience a feeling that is similar to playing an actual stringed instrument.

In step S207, whether the user's string changing operation is a string changing operation to a higher pitch string or a string changing operation to a lower pitch string when viewed from the string that is currently the target to be sounded. The CPU 10 determines whether the user's string changing operation is a string changing operation to a higher pitch string or a string changing operation to a lower pitch string when viewed from the string that is currently the target to be sounded by referring to the angular acceleration of the controller 5 in the yaw direction which was updated in step S005 of the simulation processing. With the example shown in this embodiment, the yaw to the left direction is shown as a positive value and the yaw to the right direction is shown as a negative value. As described above, in this embodiment, the controller 5 is gripped by the user in a state of being tilted 90 degrees (status of being rolled 90 degrees), and the operation of tilting the tip of the controller 5 vertically when viewed from the user will be the operation toward the yaw direction. With a violin, when the user holds the instrument with one's left hand and holds the bow with one's right hand as normally done, the low pitch string is drawn toward the tip of the bow and the high pitch string is drawn toward the base end. Thus, when the yaw value is negative (when the operation tilts the tip of the controller 5 upward, it is determined that the user's string changing operation is a string changing operation to a higher pitch string, and, when the yaw value is positive (when the operation tilts the tip of the controller 5 downward), it is determined that the user's string changing operation is a string changing operation to lower pitch string. When it is determined as a string changing operation to a higher pitch string, the processing proceeds to step S208. Meanwhile, when it is determined as a string changing operation to a lower pitch string, the processing proceeds step S210.

In step S208 and step S209, string changing to a higher pitch string is executed. The CPU 10 determines whether the string that is currently the target to be sounded is the highest pitch string (E string in the case of a violin) by referring to the string designation parameter (step S208). Here, when it is determined that the string that is currently the target to be sounded is the highest pitch string, since it is not possible to perform string changing to a higher pitch string, string changing is not performed, and the processing proceeds to step S212. Meanwhile, when it is determined that the string that is currently the target to be sounded is not the highest pitch string, the CPU 10 sets a value showing a string that is the next higher pitch string than the string that is currently the target to be sounded in the string designation parameter (step S209). The processing thereafter proceeds to step S212.

In step S210 and step S211, string changing to a lower pitch string is executed. The CPU 10 determines whether the string that is currently the target to be sounded is the lowest pitch string (G string in the case of a violin) by referring to the string designation parameter (step S210). Here, when it is determined that the string that is currently the target to be sounded is the lowest pitch string, since it is not possible to perform string changing to a lower pitch string, string changing is not performed, and the processing proceeds to step S212. Meanwhile, when it is determined that the string that is currently the target to be sounded is not the lowest pitch string, the CPU 10 sets a value showing a string that is the next lower pitch string than the string that is currently the target to be sounded in the string designation parameter (step S211). The processing thereafter proceeds to step S212.

In step S212, the string change preparation flag is turned OFF. The CPU 10 turns OFF the string change preparation flag upon the determination on whether the string changing was executed (step S209 or step S211), or the determination that string changing cannot be performed (step S208 or step S210). The processing shown in this flowchart is thereafter ended.

Figure 13:
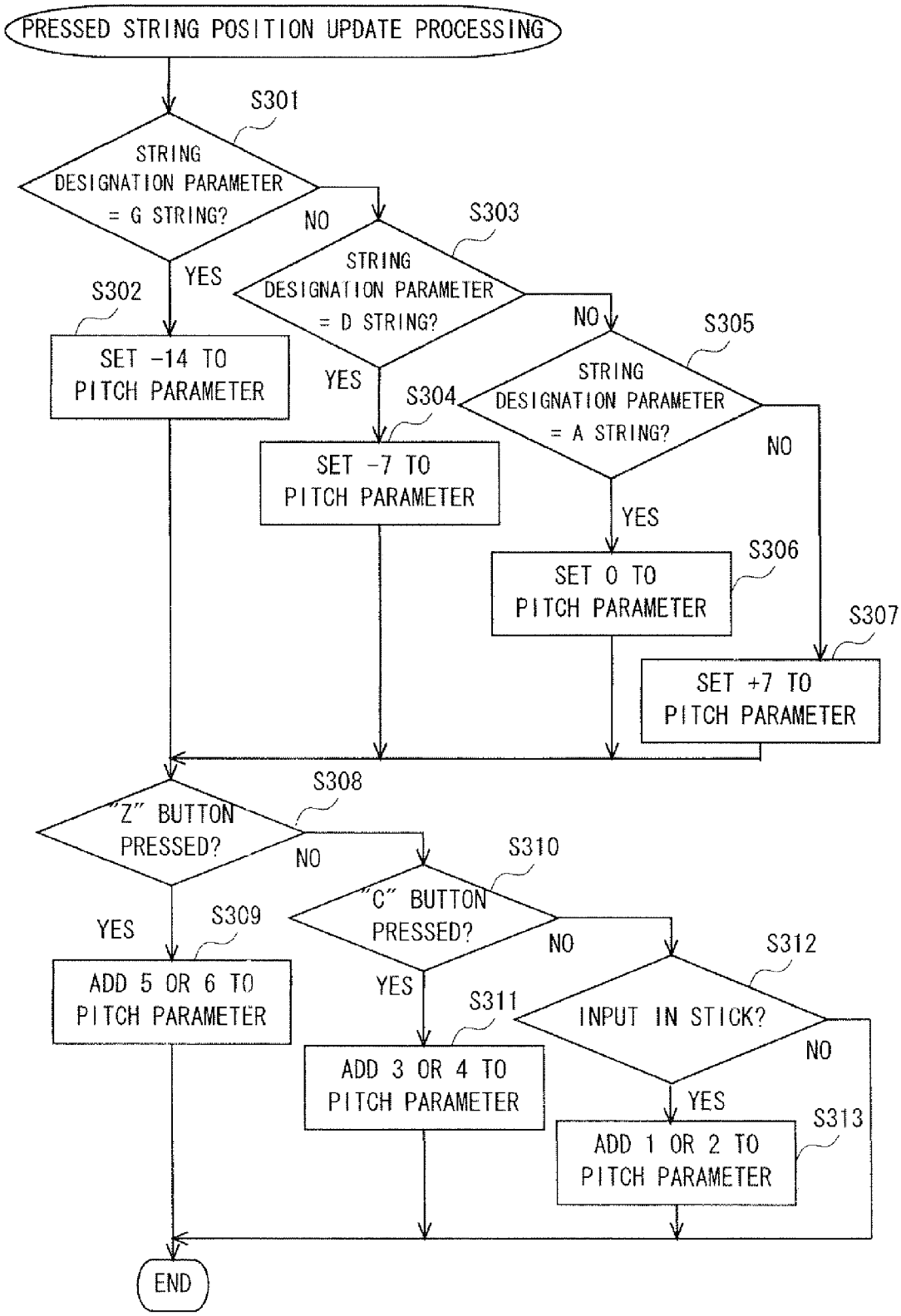
FIG. 13 is a flowchart showing the flow of the pressed string position update processing according to the embodiments.

FIG. 13 is a flowchart showing the flow of the pressed string position update processing according to this embodiment.

In step S301 to step S307, the pitch parameter according to the relevant string is set based on the string that is current the target to be sounded. The CPU 10 determines whether the string that is currently the target to be sounded by referring to the string designation parameter and sets the pitch parameter according to the determination result. Specifically, the CPU 10 sets −14 as the pitch parameter when the string designation parameter is a value showing the G string (step S301 and step S302), sets −7 as the pitch parameter when the string designation parameter is a value showing the P string (step S303 and step S304), sets 0 (zero) as the pitch parameter when the string designation parameter is a value showing the A string (step S305 and step S306), and sets +7 as the pitch parameter when the string designation parameter is a value showing the E string (step S307). The processing thereafter proceeds to step S308.

In step S308 to step S313, the pitch parameter is changed based on the user's string pressing operation. The CPU 10 determines whether any one of the Z button 78*e*, the C button 78*d*, and the stick 78*a* is of a pressed state by referring to the operational data that was updated in step S004 of the simulation processing. The CPU 10 adds 5 or 6 to the pitch parameter (step S308 and step S309) when the Z button 78*e* is pressed, adds 3 or 4 to the pitch parameter (step S310 and step S311) when the C button 78*d* is pressed, and adds 1 or 2 to the pitch parameter (step S312 and step S313) when the stick 78*a* is a value other than 0. If no button is pressed ("No" in step S312), the pitch parameter is not changed. Note that, in this embodiment, a value according to the key and scale used in the performance is added to the pitch parameter. The CPU 10 refers to a pre-set key and scale and decides whether the value added to the pitch parameter is any of the value shown in the explanation of foregoing step S308 to step S313. For example, when performing in concert with the song playing in the game, the setting may be automatically made to match the tonality (key and mode) that song. The processing shown in this flowchart is thereafter ended.

Note that, as can be understood from the flowcharts, the buttons used for the string pressing operation are prioritized. In other words, if a plurality of buttons for string pressing are being pressed, as with the pitch being decided according to the location of the pressed string on the higher pitch side in an actual instrument, the pitch parameter is decided by giving preference to the buttons in which a greater value is added to the pitch parameter. Thus, the user perform with a feeling that is similar to playing an actual instrument.

[Bowing Update Processing]

Figure 14A:
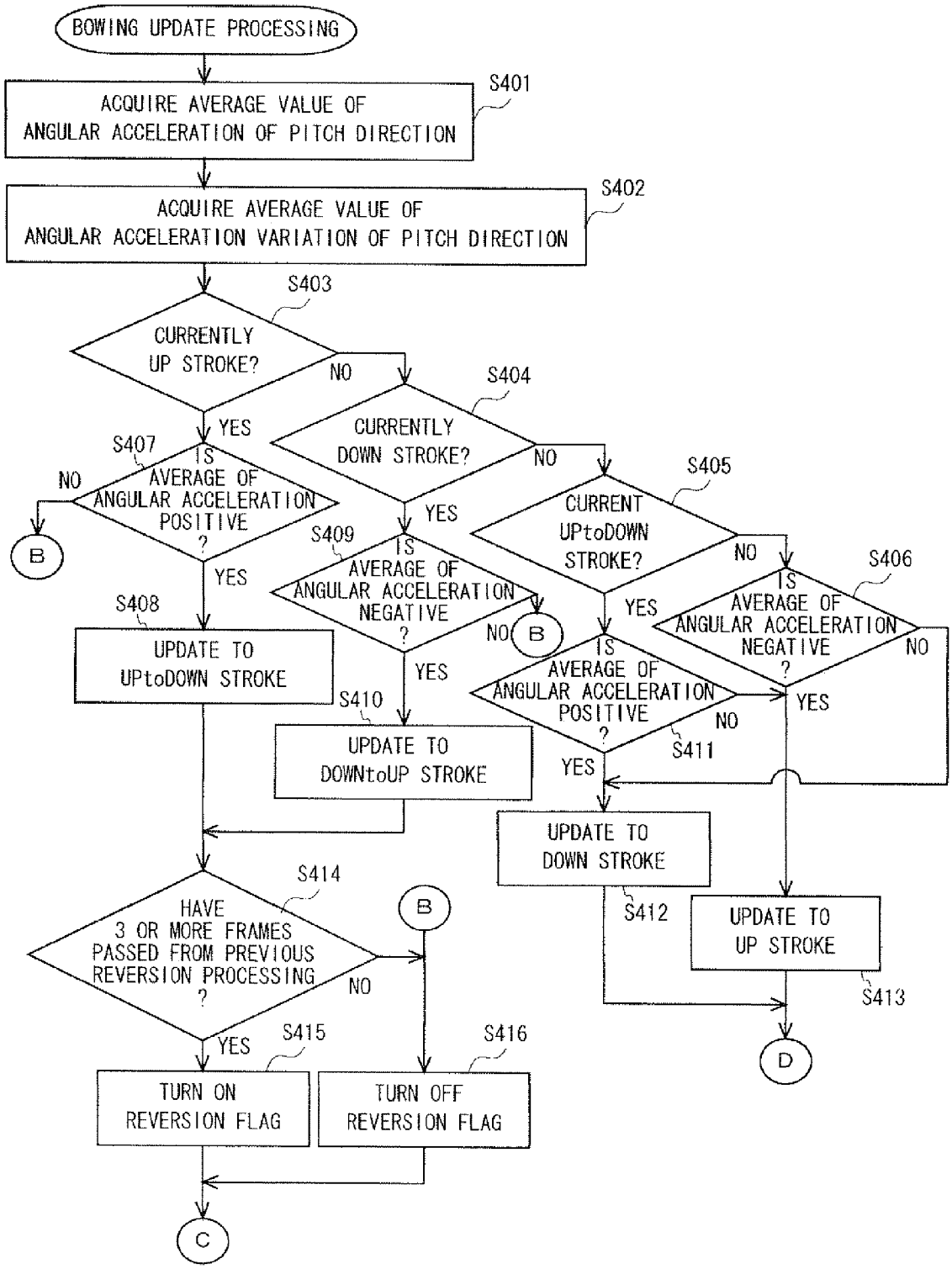
FIG. 14A is a flowchart A showing the flow of the bowing update processing according to the embodiments.
Figure 14B:
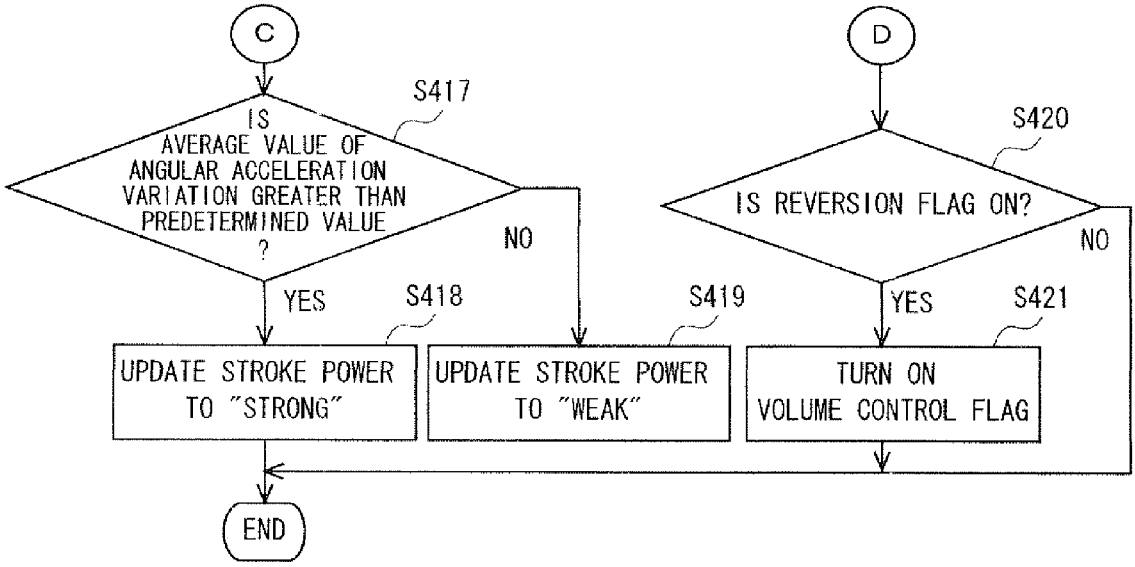
FIG. 14B is a flowchart B showing the flow of the bowing update processing according to the embodiments.

FIG. 14A and FIG. 14B are flowcharts showing the flow of the bowing update processing according to this embodiment.

In step S401 and step S402, the average value of the angular acceleration in the pitch direction (hereinafter referred to as the "average angular acceleration ACC_AVE2") and the average value of the angular acceleration variation (hereinafter referred to as the "average angular acceleration variation V_AVE8") which are used in the bowing update processing are acquired. The CPU 10 acquires two frames' worth of the angular acceleration of the controller 5 in the pitch direction that was updated in step S005 of the simulation processing, and calculates the average thereof (step S401). Moreover, the CPU 10 acquires eight frames' worth of the angular acceleration variation of the controller 5 in the pitch direction that was updated in step S005 of the simulation processing, and calculates the average thereof (step S402). Note that, in this embodiment, in consideration of the fact that variation will occur in the measurement values acquired from the gyro sensors 55, 56, the average angular acceleration ACC_AVE2 and the average angular acceleration variation V_AVE8 are calculated and referred to, the angular acceleration and angular acceleration variation referred to are not limited to the average value. The processing thereafter proceeds to step S403.

In step S403 to step S413, the stroke status is updated based on the current stroke status and angular acceleration. The CPU 10 updates the stroke status based on the current stroke status and the average angular acceleration ACC_AVE2 calculated in step S401. In this embodiment, during the UP stroke, the angular velocity in the pitch direction is shown as a negative value, and, during the DOWN stroke, the angular velocity in the pitch direction is shown as a positive value. Thus, the movement of the user slowing the speed of one's hand during the UP stroke and the movement of the user increasing the speed of one's hand upon actually starting the DOWN stroke are represented as a positive angular acceleration. Moreover, the movement of the user accelerating the speed of one's hand during the DOWN stroke and the movement of increasing the speed of one's hand upon actually starting the UP stroke are represented as a negative angular acceleration.

Accordingly, when the current stroke status is set as the UP stroke and the average angular acceleration ACC_AVE2 is positive, the CPU 10 determines that the user started the movement for the DOWN stroke during the UP stroke, and sets the stroke status to the UP to DOWN stroke (steps S403, S407 and S406). Moreover, when the current stroke status is set to the DOWN stroke and the average angular acceleration ACC_AVE2 is negative, the CPU 10 determines that the user started the movement for the UP stroke during the DOWN stroke, and sets the stroke status to the DOWN to UP stroke (steps S404, S409 and S410). The processing thereafter proceeds to step S414.

Moreover, since the CPU 10 can determine that the user started the DOWN stroke when the current stroke status is set to the UP to DOWN stroke and the average angular acceleration ACC_AVE2 is positive, the CPU 10 sets the stroke status to the DOWN stroke (steps S405, S411 and S412). Moreover, since the CPU 10 can determine that the user started the UP stroke when the current stroke status is set to the DOWN to UP stroke and the average angular acceleration ACC_AVE2 is negative, the CPU 10 sets the stroke status to the UP stroke (steps S406 and S413). The processing thereafter proceeds to step S420.

When the current stroke status is set to the UP stroke and the average angular acceleration ACC_AVE2 is not positive, since it is possible to determine that the UP stroke is being continued, the CPU 10 does not update the stroke status ("No" in step S407). Similarly, when the current stroke status is set to the DOWN stroke and the average angular acceleration ACC_AVE2 is not negative, since it is possible to determine that the DOWN stroke is being continued, the CPU 10 does not update the stroke status ("No" in step S409). When the stroke status is not updated, the processing proceeds to step S416.

In other words, with the processing shown in this embodiment, the stroke status is set in the order of "UP stroke→UP to DOWN stroke a DOWN stroke→DOWN to UP stroke→UP stroke . . . " according to the user's movement. The bowing movement upon playing the violin in this embodiment is thereby acquired.

However, when the current stroke status is set to the UP to DOWN stroke but the average angular acceleration ACC_AVE2 is not positive, the CPU 10 performs the setting of returning the stroke status to the UP stroke (steps S411 and S413). Similarly, when the current stroke status is set to the DOWN to UP stroke but the average angular acceleration ACC_AVE2 is not negative, the CPU 10 performs the setting of returning the stroke status to the DOWN stroke (steps S406 and S412). The processing thereafter proceeds to step S420.

In step S414 to step S416, the reversion flag is set based on the elapsed time from the completion of the previous reversion processing. In this embodiment, since the angular acceleration in the pitch direction is updated for each frame that is divided by 60 frames/second, the positive and negative of the average angular acceleration ACC_AVE2 could frequently be switched due to the user's unintended hand movement. Thus, the CPU 10 determines whether three frames or more have elapsed from the completion of the previous reversion processing in order to avoid erroneously determining the switching of the positive and negative of the average angular acceleration ACC_AVE2 which occurs due to the user's unintended minute hand movements to be a reversion operation (step S414). Note that the completion of the previous reversion processing can be, for example, the timing that the volume control flag is turned OFF in step S608 described later. When it is determined that three frames or more have elapsed from the completion of the previous reversion processing, the CPU 10 turns ON the reversion flag (step S415). Meanwhile, when it is determined that three frames or more have not elapsed from the completion of the previous reversion processing, the CPU 10 turns OFF the reversion flag (step S416). Moreover, the CPU 10 also turns OFF the reversion flag in cases where the stroke status was not updated due to the determination result in step S407 or step S409 (step S416). The processing thereafter proceeds to step S417.

In step S417 to step 1419, the stroke power, is set based on the average angular acceleration variation V_AVE8. The CPU 10 sets the stroke power based on the average angular acceleration variation V_AVE8 calculated in step S402. The average angular acceleration variation V_AVE8 during the reversion operation shows the user's level of force during the reversion operation. Thus, the CPU 10 compares the average angular acceleration variation V_AVE8 with a predetermined threshold (for example, 0.04) (step S417), and sets "strong" as the stroke power when the average angular acceleration variation V_AVE8 is exceeding a predetermined threshold. Meanwhile, the CPU 10 sets "weak" as the stroke power when the average angular acceleration variation V_AVE8 is not exceeding a predetermined threshold. The processing shown in this flowchart is thereafter ended.

In step S420 and step S421, the volume control flag is set according to the contents of the reversion flag. The CPU 10 refers to the reversion flag that was set during the execution of the bowing update processing in the previous frame (step S420), and turns ON the volume control flag if the reversion flag is ON (step S421). Meanwhile, if the reversion flag is OFF, the volume control flag is not set ("No" in step S420). The processing shown in this flowchart is thereafter ended.

Note that, in this embodiment, the UP to DOWN stroke and the DOWN to UP stroke are set as transient stroke statuses to manage the change of the stroke status, but depending on the embodiment, necessary to use the UP to DOWN stroke and the DOWN to UP stroke. In the foregoing case, the stroke status is set in the order of "UP stroke→DOWN stroke→UP stroke . . . " according to the user's movement. When the UP to DOWN stroke and the DOWN to UP stroke are not set, the CPU 10 refers to the reversion flag for each frame or in the frame that is subsequent to the frame in which the stroke status was changed, and thereby sets the volume control flag according to the contents of the reversion flag.

[Volume Update Processing]

Figure 15:
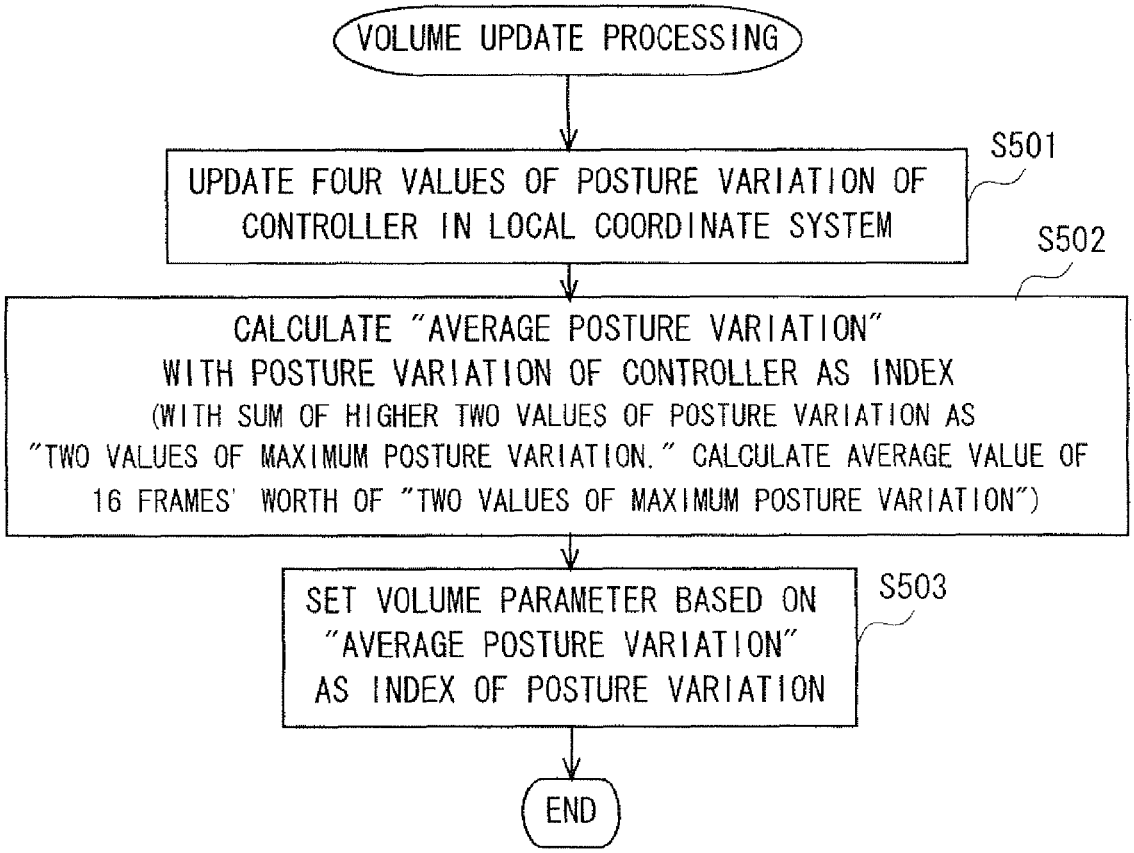
FIG. 15 is a flowchart showing the flow of the volume update processing according to the embodiments.

FIG. 15 is a flowchart showing the flow of the volume update processing according to this embodiment.

In step S501, the posture variation of the controller 5 in the local coordinate system is updated. The CPU 10 calculates the posture variation of the controller 5 in the local coordinate system based on the respective angular velocities of the yaw direction, the pitch direction, and the roll direction of the controller 5 which were updated in step S004 of the simulation processing. This calculation is performed for each frame based on the latest angular velocity that was updated for each frame.

Specifically, the CPU 10 calculates the posture variation of the controller 5 per unit time by representing the travel distance of the Y-axis and the Z-axis of the controller coordinate system during one frame as the vector in the local coordinate system. However, in the volume update processing according to this embodiment, the posture of the controller 5 is defined only with the Y-axis and the Z-axis of the controller coordinate system, and the posture variation of the controller 5 is calculated only regarding the x component and the z component of the local coordinate system. This posture variation can be calculated based on the respective angular velocities of the yaw direction, the pitch direction, and the roll direction of the controller 5.

In other words, in this embodiment, the CPU 10 calculates the posture variation dirY_x of the x component in the local coordinate system and the posture variation dirY_z of the z component in the local coordinate system as the posture variation of the Y-axis of the controller coordinate system, and calculates the posture variation dirZ_x of the x component in the local coordinate system and the posture variation dirZ_z of the z component in the local coordinate system as the posture variation of the Z-axis of the controller coordinate system. In other words, in this embodiment, the four values of posture variations dirY_x, dirt z, dirZ_x and dirZ_z are calculated as the posture variation. For example, the travel distance of the points (0, 1, 0) on the Y-axis and the points (0, 0, 1) on the Z-axis of the controller coordinate system in the local coordinate system can be represented with the vectors (only the x component and z component in this embodiment) on the local coordinate system, and this can be used as the posture variation. The processing thereafter proceeds to step S502. Note that, in this embodiment, as the posture variation, the posture variations dirY_x, dirY_z, dirZ_x and dirZ_z are calculated as the information for acquiring the volume parameter, but in the other embodiments, it is also possible to adopt a method of associating the angular velocity and the volume parameter in advance, and acquiring the volume parameter based on the angular velocity itself acquired from the gyro sensors.

Note that, in this embodiment, the four values of the posture variations dirY_x, dirZ_z, dirZ_x and dirZ_z are calculated as the posture variation, but this is because, in the strokes of playing the violin, the movements reflected in the x component and z component in the local coordinate system are primary (posture change of the Y-axis and Z-axis of the controller 5), and the movements mainly reflected in the y component in the local coordinate system (posture change of the X-axis of the controller 5) are small (provided that this excludes string changing movements). Thus, the combination of components of the local coordinates and the axes of the controller 5 calculated as the posture variation is not limited to the four values shown in this embodiment. The posture variations are preferably adopted suitably according to the simulation target, and the combination of all xyz components of the local coordinate system and all XYZ axes of the controller 5 (in other words, nine values) can also be calculated.

In step S502, the average posture variation MM_AVE16 of the "two values of maximum posture variation" is calculated as the posture variation used in acquiring the volume parameter. The CPU 10 calculates the "two values of maximum posture variation" by integrating the two values in descending order of value among the posture variations dirY_x, dirY_z, dirZ_x and dirZ_z which were calculated in step S501. If the movement of the controller 5 satisfies predetermined conditions during the bowing (for example, the movement of the controller 5 becomes a movement that is close to parallel to a certain axis), certain posture variations could become saturated (posture variation cannot be obtained). According to this embodiment, by combining a plurality of posture variations according to different axes and components, even if certain posture variations become saturated, it is possible to obtain an appropriate posture variation for acquiring the volume parameter.

Note that the "two values of maximum posture variation" calculated above are retained for at least 16 frames in the internal main memory 11*e* or the external main memory 12 by being associated with information that is capable of identifying the calculated frame. The CPU 10 subsequently calculates the average posture variation MM_AVE16 by averaging the "two values of maximum posture variation" that were calculated in the latest 16 frames including the frame that is currently being processed. Note that, in this embodiment, consideration of the fact that variations will occur in the measurement values acquired from the gyro sensors 55, 56, the average value of the posture variations is calculated and referred to, but the posture variation to be referred for acquiring the volume parameter is not limited to the average value. Moreover, in this embodiment, although the higher two values are totaled, it will suffice if a plurality of posture variations according to different components are totaled in order to avoid the saturation of posture variations according to a specific component, and this is not limited to two values. For example, all calculated posture variations may be totaled. The processing thereafter proceeds to step S503.

In step S503, the volume parameter for deciding the volume of sound signals to be output from the game device 3 is set based on the posture variation. The CPU 10 acquires and sets the volume parameter according to the average posture variation MM_AVE16 that was calculated as the posture variation to be used in acquiring the volume parameter in step S502. The average posture variation MM_AVE16 is a value based on the posture variation of the controller 5, and is a value that is less influenced by the user's unintended movement as a result of being averaged. Thus, according to this embodiment, a natural volume parameter can be set according to the user's intent. The processing shown in this flowchart is thereafter ended.

Figure 16:
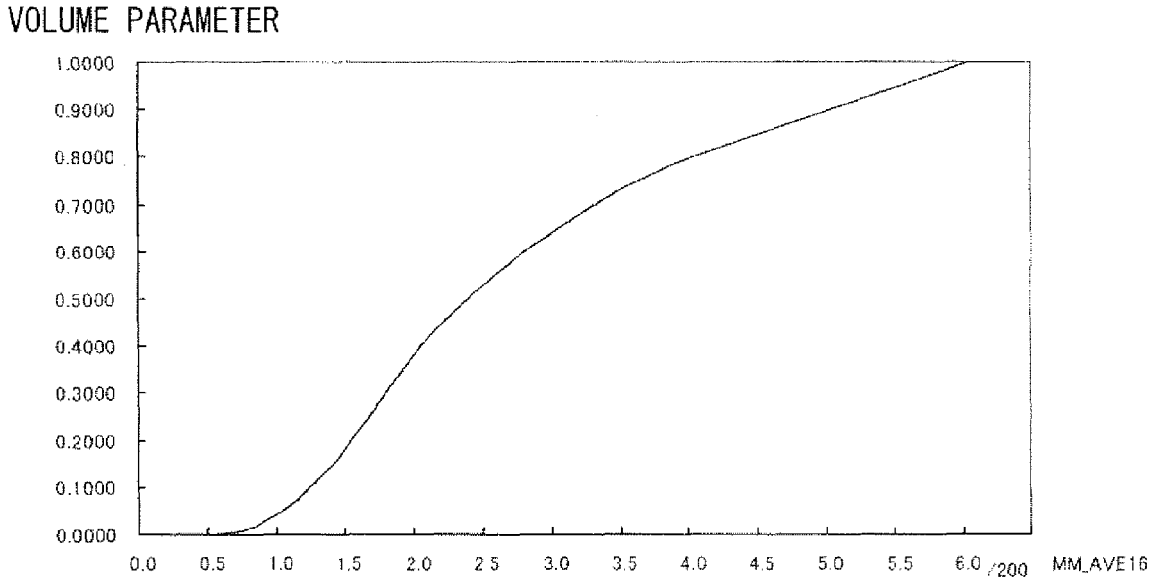
FIG. 16 is a diagram showing a map representing the relationship of the posture variation and volume parameter in the embodiments.

FIG. 16 is a diagram showing a map representing the relationship of the posture variation and the volume parameter in this embodiment. In this embodiment, the volume parameter according to the average posture variation MM_AVE16 is acquired by referring to the map shown in FIG. 16. In this embodiment, the volume parameter is a parameter showing the ratio relative to the volume when the value (maximum volume, maximum amplitude value) upon outputting the data of the sound waveform without lowering the volume is set to 1.0000. The tendency of inclination of change of the volume parameter relative to change of the posture variation in the map which prescribes the correspondence of the posture variation (average posture variation MM_AVE16) and the volume parameter differs for each range of the posture variation. According to the example shown in FIG. 16, when the posture variation is sufficiently small (less than 0.5 in the example shown in FIG. 16), the volume parameter is set to silent (0.0000) even if a stroke is detected. When the posture variation is sufficiently great (6.0 or more in the example shown in FIG. 16), the volume parameter is set to the maximum volume (1.0000). Moreover, when the posture variation is relatively small (0.5 or more and 2.0 or less in the example shown in FIG. 16), a volume parameter that is exponentially great will be set pursuant to the increase in the posture variation, but when the posture variation is a medium-level variation during the performance of the violin (2.0 or greater and less than 4.0 in the example shown in FIG. 16), the increase of the volume parameter will become gradual pursuant to the increase of the posture variation. When the posture variation is relatively great (4.0 or more and less than 4.0 in the example shown in FIG. 16), change of the volume parameter pursuant to the increase of the posture variation will be a linear change with a small inclination. Thus, according to this embodiment, it is possible to provide a natural volume change where the sound rises smoothly at the stage that the bowing speed is relatively slow, and the volume reaches its upper limit as the bowing speed becomes sufficiently fast.

Note that, in this embodiment, although a method of referring to the map and acquiring the volume parameter according to the average posture variation MM_AVE16 was explained, in substitute for this kind of method, the CPU 10 may also calculate the volume parameter according to the average posture variation MM_AVE16 by using the relational expression prescribing the correspondence of the posture variation and the volume parameter. In the foregoing case, natural volume change can be provided by using a relational expression in which the tendency of inclination of change of the volume parameter relative to change of the posture variation differs for each range of the posture variation.

[Sound Signal Output Processing]

Figure 17:
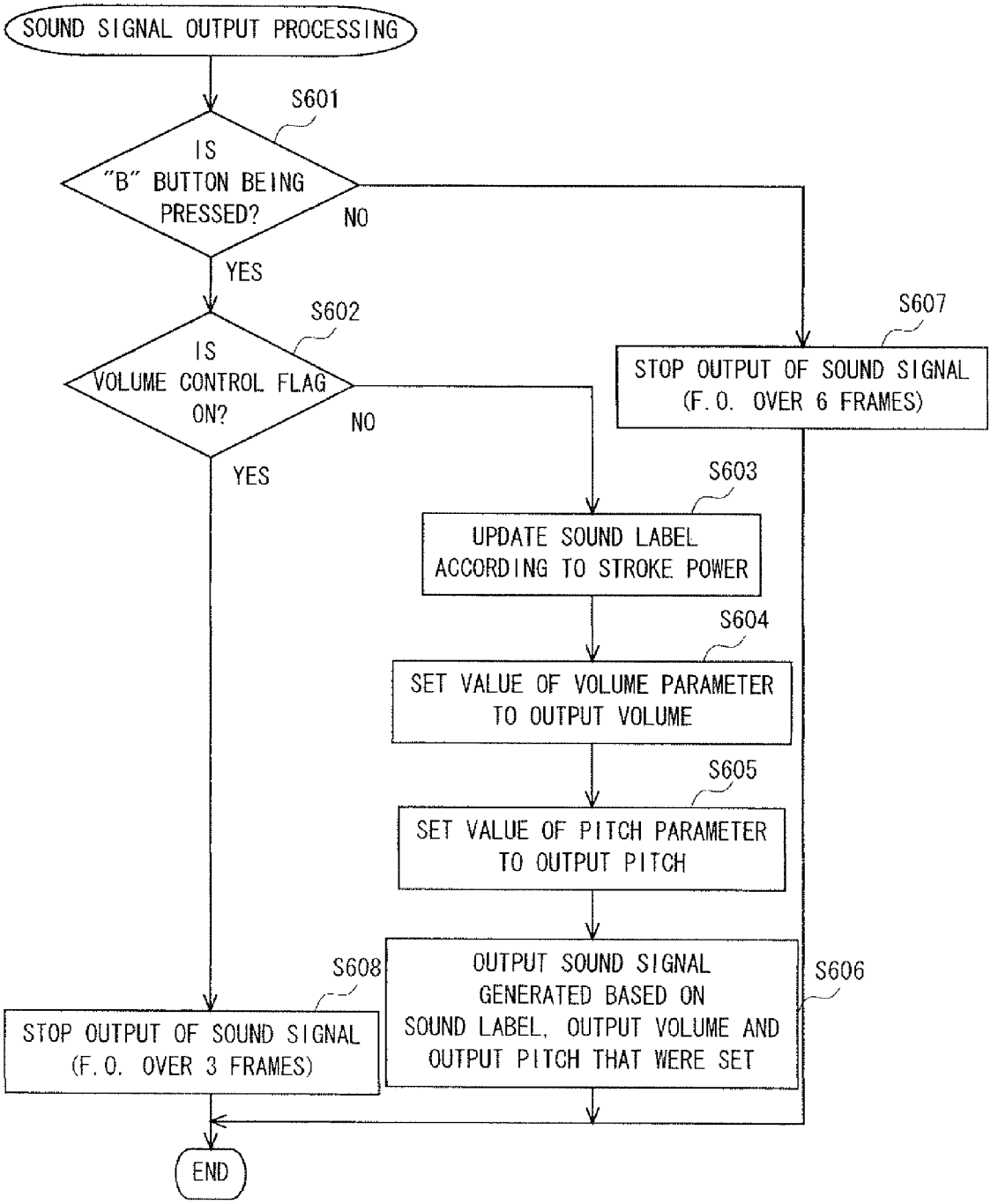
FIG. 17 is a flowchart showing the flow of the sound signal output processing according to the embodiments.

FIG. 17 is a flowchart showing the flow of the sound signal output processing according to this embodiment.

In step S601, the status of the B button 32*i* is determined. The CPU 10 determines whether the B button 32*i* is of a pressed state by referring to the operational data that was updated in step S004 of the simulation processing. When it is determined that the B button 32*i* is being pressed, the processing proceeds to step S602. Meanwhile, when it is determined that the B button 32*i* is not being pressed, the processing proceeds to step S607.

Here, the B button 32*i* is used as the button for designating the output of the sound signals. As a result of outputting the sound signals only while the B button 32*i* is being pressed, it is possible to prevent the sound signals from being output in cases where the user unintentionally moves the controller 5. Moreover, in the game device 3 according to this embodiment, since the B button 32*i* is provided at a position where it will be pressed by the index finger of the right hand when the user grips the controller 5 with one's right hand, the user can adopt a posture that is similar to playing the violin.

In step S602, the status of the volume control flag is determined. The CPU 10 determines whether the reversion operation in the bowing is being performed by referring to the volume control flag. As described above, the volume control flag is a flag for yielding the effect of lowering the volume during the reversion operation, and the volume control flag turned. ON in step S421 of the bowing update processing. When it is determined that the volume control flag is ON; that is, that the reversion operation in the bowing is being performed, the processing proceeds to step S608. Meanwhile, when it is determined that the volume control flag is OFF; that is, that the reversion operation in the bowing is not being performed, the processing proceeds to step S603.

In step S603 to step S606, the sound signals are output according to the settings that were set in the foregoing pitch update processing, bowing update processing, volume update processing, and sound signal output processing. The CPU 10 updates the sound label to the sound label according to the stroke power (step S603). In other words, in step S606 described later, the sound signals based on the sound label set in step S603 are generated and output. Moreover, the CPU 10 sets the value of the volume parameter that was set in the volume update processing as the output volume (step S604), and sets the value of the pitch parameter that was set in the pitch update processing as the output pitch (step S605). Subsequently, the sound signals generated by the DSP 11*c* based on the sound label set in step S603, the output volume set in step S604, and the output pitch set in step S605 are output (step S606), and sound according to the sound signals s output from the speaker 2*a*. The processing shown in this flowchart is thereafter ended.

In step S607, output of the sound signals is stopped. The CPU 10 stops the output of the sound signals from the game device 3 upon the determination that the B button 32*i* is not being pressed in step S601. Note that this stop of output involves a fadeout over six frames. The CPU 10 gradually lowers the volume of the sound signals over six frames, and stops the output of the sound signals from the game device 3. The processing shown in this flowchart is thereafter ended.

In step S608, the reversion processing associated with the user's reversion operation is executed, the CPU 10 stops the output of the sound signals from the game device 3 upon the determination that the volume control flag is ON in step S602; that is, that the reversion operation in the bowing is being performed. As a result of the above, the volume can be changed pursuant to the user's reversion operation, and the user can experience a sensation as though actually playing the violin. Note that this stop of output involves a fadeout over three frames. The CPU 10 gradually lowers the volume of the sound signals over three frames, and stops the output of the sound signals from the game device 3. Moreover, the CPU 10 turns OFF the volume control flag as a result of the reversion processing pursuant to the user's reversion operation being executed.

Note that the components of the posture variation used in the simulation processing according to this embodiment are suitable for cases where a violin is the simulation target, and the components of the posture variation used in the simulation processing are not limited to those shown in this embodiment. The components of the posture variation used the simulation processing may be suitably decided according to the arrangement of the sounding body that is adopted in the sounding device of the simulation target or the direction of movement of frictioning (stroking) the sounding body. The sounding device to become the simulation target may also be other sounding devices and, for example, other bow-drawn stringed instruments such as a cello may be used as the simulation target.

Moreover, in this embodiment, an embodiment was explained where the gyro sensors built into the controller were used to measure the angular velocity and the like and thereby acquiring the posture variation of the controller, but the means for measuring the movement of a predetermined target upon working this invention is not limited to sensors provided to the controller. For example, as another embodiment, it is also possible to measure the user's hand movement using a sensor of a camera or the like, and thereby obtain the posture variation of the user's hand based on the measurement results.

What is claimed is:

1. A computer-readable non-transitory medium storing program instructions for musical performance that are executable by a computer of a musical performance apparatus which simulates a stringed instrument having a plurality of strings stretched in substantially the same direction and outputs sound based on movement of a predetermined target, the program instructions causing the computer to perform operations comprising:

acquiring posture variation of the predetermined target in a predetermined interval based on measurement information concerning a posture or movement of the predetermined target;

setting a volume parameter for deciding a volume according to an acquired posture variation; and outputting a sound signal of a volume according to the volume parameter;

retaining string designation information which designates a string that is currently a target to be sounded among the plurality of strings; and changing a string designation upon a determination, based on the measurement information, that angular acceleration in a circumferential direction centered about a direction in which the plurality of strings are stretched has exceeded a predetermined threshold.

2. The computer-readable non-transitory medium according to claim 1, wherein the posture variation is acquired as a result of calculating a posture variation of the predetermined target in a predetermined interval relative to a coordinate system defined in a real space based on the measurement information.

3. The computer-readable non-transitory medium according to claim 2, wherein acquiring posture variation further includes acquiring a plurality of posture variations of the predetermined target relative to axes of the coordinate system defined in the real space, and the volume parameter is set based on the first two or more but not all of the acquired posture variations in descending order of value among a plurality of acquired posture variations.

4. The computer-readable non-transitory medium according to claim 3, wherein acquiring posture variation further includes acquiring four posture variations of two axes for defining the posture of the predetermined target relative to two axes in the coordinate system defined in the real space, for each combination of axes, and wherein the volume parameter is set based on two posture variations in a descending order of value among the four posture variations.

5. The computer-readable non-transitory medium according to claim 1, wherein acquiring posture variation includes determining, as a posture variation, an average value of posture variations acquired a plurality of times within a predetermined period.

6. The computer-readable non-transitory medium according to claim 1, which causes the computer to perform further operations including:

control of output volume by stopping the output of the sound signal for a predetermined time or lowering the output volume of the sound signal when it is determined, based on the measurement information, that a positive or negative value of angular acceleration in a predetermined direction has inverted.

7. The computer-readable non-transitory medium according to claim 1, wherein the volume parameter is set based on information prescribing a correspondence of the posture variation and the volume parameter, and in the information prescribing the correspondence of the posture variation and the volume parameter, tendency of inclination of change of the volume parameter relative to change of the posture variation differs for each range of posture variation.

8. The computer-readable non-transitory medium according to claim 1, wherein the predetermined target is a controller with a built-in gyro sensor to be operated by a user, and the measurement information is angular velocity or angular acceleration measured by the gyro sensor.

9. A musical performance apparatus simulates a stringed instrument having a plurality of strings stretched in substantially the same direction for outputting sound based on movement of a predetermined target, comprising:

posture variation acquirer that determines a posture variation of the predetermined target in a predetermined interval based on measurement information concerning the posture or movement of the predetermined target;

sound output volume controller that sets a volume parameter for deciding a volume according to the posture variation;

sound signal output generator that outputs a sound signal having a volume according to the volume parameter;

string designation information retaining unit that retains string designation information which designates a string that is currently a target to be sounded among the plurality of strings; and string changer that changes the string designation upon a determination, based on the measurement information, that angular acceleration in a circumferential direction centered about a direction in which the plurality of strings are stretched has exceeded a predetermined threshold.

10. A computer-readable non-transitory medium storing program instructions executable by a computer, the program instructions causing the computer to perform operations comprising:

acquiring posture variation of a predetermined target in a predetermined interval based on measurement information concerning a posture or movement of the predetermined target;

setting a parameter according to an acquired posture variation; and outputting a signal according to the parameter, wherein the posture variation is acquired as a result of calculating a posture variation of the predetermined target in a predetermined interval relative to a coordinate system defined in a real space based on the measurement information, and wherein acquiring posture variation further includes acquiring a plurality of posture variations of the predetermined target relative to axes of the coordinate system defined in the real space, and the parameter is set based on the first two or more but not all of the acquired posture variations in a descending order of value.

11. The computer-readable non-transitory medium according to claim 10, wherein acquiring posture variation further includes acquiring four posture variations of two axes for defining the posture of the predetermined target relative to two axes in the coordinate system defined in the real space, for each combination of axes, and wherein the parameter is set based on the first two posture variations in a descending order of value among the four posture variations.

12. The computer-readable non-transitory medium according to claim 10, wherein acquiring posture variation includes determining, as a posture variation, an average value of posture variations acquired a plurality of times within a predetermined period.

13. The computer-readable non-transitory medium according to claim 10, which causes the computer to perform further operations including:

stopping the output of the signal for a predetermined time or lowering the output of the signal when it is determined, based on the measurement information, that a positive or negative value of angular acceleration in a predetermined direction has inverted.

14. The computer-readable non-transitory medium according to claim 10, wherein the parameter is set based on information prescribing a correspondence of the posture variation and the parameter, and in the information prescribing the correspondence of the posture variation and the parameter, tendency of inclination of change of the parameter relative to change of the posture variation differs for each range of posture variation.

15. An apparatus, comprising:

posture variation acquirer that determines a posture variation of a predetermined target in a predetermined interval based on measurement information concerning a posture or movement of the predetermined target;

parameter controller that sets a parameter valve for deciding an output according to the posture variation; and signal generator that outputs a signal according to the parameter, wherein the posture variation is acquired as a result of calculating a posture variation of the predetermined target in a predetermined interval relative to a coordinate system defined in a real space based on the measurement information, and wherein the posture variation acquirer acquires a plurality of posture variations of the predetermined target relative to axes of the coordinate system defined in the real space, and the parameter is set based on the first two or more but not all of the acquired posture variations in a descending order of value.

16. A computer-readable non-transitory medium storing program instructions executable by a computer, the program instructions causing the computer to perform operations comprising:

acquiring posture variation of a predetermined target in a predetermined interval based on measurement information concerning a posture or movement of the predetermined target;

setting a parameter for deciding an output according to an acquired posture variation;

outputting a signal according to the parameter; and stopping the output of the signal for a predetermined time or lowering the output of the signal when it is determined, based on the measurement information, that a positive or negative value of angular acceleration in a predetermined direction has inverted.

17. The computer-readable non-transitory medium according to claim 16, wherein acquiring posture variation further includes acquiring four posture variations of two axes for defining the posture of the predetermined target in a predetermined interval relative to two axes in the coordinate system defined in the real space, for each combination of axes, and wherein the parameter is set based on the first two posture variations in a descending order of value among the four posture variations.

18. The computer-readable non-transitory medium according to claim 16, wherein acquiring posture variation includes determining, as a posture variation, an average value of posture variations acquired a plurality of times within a predetermined period.

19. The computer-readable non-transitory medium according to claim 16, wherein the parameter is set based on information prescribing a correspondence of the posture variation and the acquired parameter, and in the information prescribing the correspondence of the posture variation and the parameter, tendency of inclination of change of the parameter relative to change of the posture variation differs for each range of posture variation.

20. An apparatus, comprising:

posture variation acquirer that determines a posture variation of a predetermined target in a predetermined interval based on measurement information concerning a posture or movement of the predetermined target;

parameter controller that sets a parameter for deciding an output according to the posture variation;

signal generator that outputs a signal according to the parameter; and output signal controller that stops the output of the signal by the signal generator for a predetermined time or lowers the output of the signal by the signal generator when it is determined, based on the measurement information, that a positive or negative value of angular acceleration in a predetermined direction has inverted.

* * * * *